US005478234A

United States Patent [19]

Yokota et al.

[11] Patent Number: 5,478,234

[45] Date of Patent: Dec. 26, 1995

[54] APPARATUS FOR MANUFACTURING CEMENT CLINKER

[75] Inventors: Norio Yokota, Narashino; Nichitaka Sato, Funabashi; Katsuji Mukai, Nagareyama; Toshiyuki Ishinohachi; Hideho Hayashi, both of Tochigi; Isao Hashimoto, Akashi; Mikio Murao, Kobe; Shozo Kanamori, Miki; Chikanori Kumagai, Kobe; Tatsuya Watanabe, Tochigi, all of Japan

[73] Assignees: Kawasaki Jukogyo Kabushiki Kaisha, Kobe; Sumitomo Cement Co., Ltd., Tokyo, both of Japan

[21] Appl. No.: 174,693

[22] Filed: Dec. 27, 1993

[30] Foreign Application Priority Data

| | | | |
|---|---|---|---|
| Dec. 28, 1992 | [JP] | Japan | 4-360489 |
| Dec. 28, 1992 | [JP] | Japan | 4-360492 |
| Feb. 26, 1993 | [JP] | Japan | 5-063139 |
| Mar. 31, 1993 | [JP] | Japan | 5-097079 |
| Mar. 31, 1993 | [JP] | Japan | 5-098482 |
| Mar. 31, 1993 | [JP] | Japan | 5-098484 |
| Jun. 30, 1993 | [JP] | Japan | 5-162031 |

[51] Int. Cl.[6] ..... F27B 7/02; F27B 15/00

[52] U.S. Cl. ..... 432/106; 432/14; 432/58

[58] Field of Search ..... 432/14, 58, 106

[56] References Cited

U.S. PATENT DOCUMENTS

| | | | |
|---|---|---|---|
| 3,881,862 | 5/1975 | Nishida et al. | 432/106 |
| 4,094,626 | 6/1978 | Boyhout et al. | 432/106 |
| 4,248,639 | 2/1981 | Quittkat | 432/106 |
| 4,715,811 | 12/1987 | Lawall | 432/106 |
| 4,717,337 | 1/1988 | Ichiyanagi et al. | 432/106 |
| 4,759,711 | 7/1988 | Ichiyanagi et al. | 432/106 |
| 4,877,397 | 10/1989 | Tatebayashi et al. | 432/106 |
| 5,156,545 | 10/1992 | Deblock et al. | 432/58 |

FOREIGN PATENT DOCUMENTS

| | | |
|---|---|---|
| 60-10198 | 1/1985 | Japan . |
| 62-225888 | 10/1987 | Japan . |
| 63-61883 | 3/1988 | Japan . |
| 63-60134 | 3/1988 | Japan . |
| 1254242 | 10/1989 | Japan . |
| 1284509 | 11/1989 | Japan . |
| 2229745 | 9/1990 | Japan . |
| 4110395 | 9/1992 | Japan . |

*Primary Examiner*—Willis R. Wolfe
*Attorney, Agent, or Firm*—Leydig, Voit & Mayer

[57] ABSTRACT

An apparatus for manufacturing cement clinker is disclosed in which raw material powder of cement pre-heated by a pre-heating unit such as a suspension pre-heater and pre-calcined by a calciner is charged into a granulating furnace as to be granulated, thus-obtained granulated material is charged into a sintering furnace as to be sintered, and the sintered material is cooled and recovered by a cooling unit, the apparatus having a granulating furnace so that the granulating performance of the granulating furnace is improved. A fuel supply unit for forming a local hot region is disposed immediately above a porous perforated distributor disposed in the throat portion between the granulating furnace and the sintering furnace so that the granulating furnace is formed into a jet fluidized bed structure, the lower portion of the granulating furnace has an inverse frustum of circular cone (a cone portion) so formed as to cause the granulated material to form a downward moving bed, and raw material powder of cement is blown through the side wall of the cone portion, and it is sufficiently dispersed in the moving bed before it reaches the local hot region.

21 Claims, 23 Drawing Sheets

APPARATUS FOR MANUFACTURING CEMENT CLINKER

BACKGROUND OF THE INVENTION

1. Field of the Invention

An apparatus for manufacturing cement clinker is such as the equipment for preheating, pre-calcining, calcining, sintering and cooling, hereinafter referred to as an apparatus.

A first aspect of the present invention relates a cement clinker manufacturing apparatus capable of lowering the temperature at which cement clinker is sintered.

A second aspect of the present invention relates to an improvement in a cement clinker manufacturing apparatus.

A third aspect of the present invention relates no an improvement in an apparatus for operating a sintering furnace of a cement clinker manufacturing apparatus.

A fourth aspect of the present invention relates to a jet fluidized bed granulating furnace having an improved perforated-plate type distributor.

A fifth aspect of the present invention relates to an improvement in an apparatus for injecting raw material of cement into a jet fluidized bed furnace.

A sixth aspect of the present invention relates no an apparatus for injecting granular raw material into any one of a variety of fluidized bed furnaces typified by a jet fluidized bed granulating furnace of raw material of cement.

A seventh aspect of the present invention relates to a jet fluidized bed granulating furnace for use as equipment for manufacturing cement clinkers (lumps before grinding state as to be formed into cement), the jet fluidized bed granulating furnace being capable of controlling the size of granulated material.

Hitherto, Portland cement clinker has been sintered at temperatures of 1400° to 1600° C. in a rotary kiln (a rotary sintering furnace). That is, the Portland cement clinker has been intended to be sintered at 1500° C. In this case, the sintering temperature allowance is about 50° to 100° C., causing the cost of energy to be raised excessively to maintain the foregoing sintering temperature. What is worse, a heavy burden must be borne to get rid of pollution.

A conventional cement clinker manufacturing apparatus, as shown in FIG. 33, comprises a pre-heating unit 1 formed by a plurality of combined pre-heating furnaces, a pre-calciner 2 for pre-calcining raw material pre-heated in the pre-heating unit 1, a rotary kiln 3 that sinters the pre-heated raw material to form clinker, a clinker cooler 4 for cooling sintered clinker and a forced blower 5 for supplying cooling air to the clinker cooler 4.

The cooled cement clinker is then conveyed to a producing process (omitted from illustration), in which the cement clinker is ground and classified, so that a cement clinker product is manufactured.

The cement clinker is sintered in the cement clinker manufacturing apparatus in such a manner that the raw material of the cement clinker is heated to 800° C. to 900° C. in the pre-heating unit 1 and the pre-calciner 2, and then the hot raw material is charged into the rotary kiln 3 as to be heated to about 1500° C. Since the heat conductivity to the raw material is low in the rotary kiln 3, it takes 10 minutes or longer to heat the cement clinker to 1300° to 1400° C. In this case, the temperature rise rate is about 50 C.°/minute or lower.

The foregoing sintering technology using the conventional manufacturing apparatus sinters cement clinker at about 1500° C. It would be desirable to sinter the cement clinker at a lower temperature of about 1300° to 1400° C. in order to save energy needed in the manufacturing apparatus and to reduce of pollution by decreasing nitrides and oxides. However, sintering of the cement clinker at the low temperature needs addition of chlorine flux or lengthening the sintering time. Therefore, the pollution prevention and cost reduction cannot be realized as desired. What is worse, there arises a first problem in that mortar and concrete suffer from unsatisfactory strength.

A conventional cement clinker manufacturing apparatus has been disclosed (for example, in Japanese Patent Unexamined Publication No. 62-230657). According to this disclosure, the apparatus comprises a suspension pre-heater, a single-nozzle spouted bed granulating furnace, a fluidized bed sintering furnace and a cooling unit, wherein a plurality of opposing burners are disposed in the lower portion of the spouted bed granulating furnace to form a local hot region in the spouted bed, and the pre-heated raw material is charged onto the local hot region.

The cement clinker manufacturing apparatus is formed by the single-nozzle spouted bed granulating furnace and the fluidized bed sintering furnace which are combined with each other. The cement clinker manufacturing apparatus requires the prevention of directly dropping of raw material powder through a throat of the spouted bed granulating furnace which results from raising the flow velocity. If the flow velocity is raised, the amount of undesirable discharge of raw material powder from the spouted bed granulating furnace increases. Therefore, there arises a problem of unstable operation occurring due to circulation of fine powder and another problem of unsatisfactory fuel consumption which is caused from the fast growth of coating. If the scale of the apparatus is enlarged, the foregoing problems of the direct drop and undesirable discharge of the raw material powder become critical. What is worse, the height of a free board of the spouted bed granulating furnace cannot be shortened. Furthermore, pressure loss becomes enlarged excessively.

A spouted bed granulating furnace has been disclosed (for example, in Japanese Utility Model Unexamined Publication No. 4-110395) in which a cone portion is formed in the lower portion, the foregoing throat portion of the spouted bed granulating furnace connected to the fluidized bed sintering furnace is formed into a porous perforated structure, opposing burners are disposed above the porous perforated structure, and a diagonal chute for supplying pre-heated raw material powder is disposed above the cone portion to face downwards.

Although the porous perforated structure of the throat portion of the spouted bed granulating furnace according to the foregoing disclosure is able to overcome the problem of the direct drop and the undesirable discharge of the raw material powder, the size of the throat cannot be enlarged satisfactorily because the local hot region must be formed in the central portion to maintain the granulating performance. What is worse, the pressure loss is increased excessively by enlarging the scale satisfactorily (a second problem).

As another conventional technology, a method of operating a granulating furnace for the purpose of controlling the granulated grain size in the spouted bed fluidized bed granulating furnace to a certain range has been disclosed, as shown in FIG. 34. According to the foregoing disclosure, a Roots blower is provided for each of a fluidized bed cooler serving as a primary cooling means and a packed bed cooler serving as a secondary cooling means and the air quantity of each of the Roots blowers is controlled so that the space velocity UO of each of the sintering furnace and the fluidized bed cooler is made constant (see, for example, Japanese Patent Unexamined Publication No. 63-61883 and Japanese Patent Unexamined Publication No. 2-229745).

The foregoing operation method cannot control the grain size to a certain range by absorbing disturbances occurring during operation, such as, change in the components of the raw material or change in the flow of the raw material. If the grain size is decreased, the grains are agglomerated in the sintering furnace. If the grain size is enlarged, a defect takes place in fluidization. In the foregoing cases, the operation cannot be stably and continuously performed, requiring that the operation be stopped and cleaning be performed (a third problem).

Another conventional technology about a perforated distributor of a granulating furnace has been disclosed (for example, in Japanese Utility Model Unexamined Publication No. 60-10198, Japanese Patent Unexamined Publication No. 1-254242 and Japanese Patent Unexamined Publication No. 1-284509) in which nozzles having the same diameter are disposed uniformly on the overall surface of the distributor.

The raw material powder fluidized bed sintering furnace disclosed in Japanese Utility Model Unexamined Publication No. 60-10198 comprises the nozzles uniformly disposed on the overall surface of the distributor. The foregoing structure of the distributor is employed as well to form the granulating furnace so that the bed temperature of the granulating furnace is made uniform. As a result, coating can easily be generated on the wall surface on the inside layer of the granulating furnace as shown in FIGS. 35 and 36. That is, the fact that the diameter of the jet stream emitted through the outermost nozzle is smaller than the nozzle pitch as shown in FIG. 36 causes coating as shown in the drawing. If large-diameter grains are generated in the granulating furnace, the grains cannot be discharged from the granulating furnace but they are accumulated on the distributor. As a result, fluidization encounters a defect, causing fluctuations in the operation over a period of time.

The fluidized bed reaction apparatus disclosed in Japanese Patent Unexamined Publication No. 1-254242 and different from the granulating furnace forms circulating flows of grains which move upwards in the periphery and which move downwards at the central portion by enlarging the degree of opening of the nozzles in the periphery. However, to assure granulating in the granulating furnace the periphery of the furnace should be formed into a cone structure and needs a downward flow in the moving bed. In order to maintain a certain downward movement speed, the degree of opening of the periphery nozzle must be the same or smaller than that at the central portion.

The gas distributor disclosed in Japanese Patent Unexamined Publication No. 1-284509 is enabled to make grains in the overall body of the fluidized bed form an eddy current by disposed caps respectively disposed on the nozzles and jetting out gas in one direction. Since the length of the jet stream gas is several hundred of millimeters in the foregoing means, adhesion of grains to he side wall of the distributor cannot be prevented although adhesion the top surface of the same can be prevented by the eddy current of the grains (a fourth problem).

A conventional apparatus for sintering cement clinker is known which has an arrangement made as shown in FIG. 37 such that pre-heated raw material powder of cement is, by gravitation, charged from a lowermost cyclone forming a suspension pre-heater to a position above the hopper of a jet fluidized bed granulating furnace (see, for example, Japanese Patent Unexamined Publication No. 63-60134 and Japanese Patent Unexamined Publication No. 62-225888).

In the conventional example shown in FIG. 37, charged (supplied) grains adjacent to an opening portion of the supply chute (on the upper wall surface of the cone portion) are in a full charged state and moved downwards along the wall surface of the cone portion. The charged raw materials are not dispersed but they reach the upper surface of the distributor because grains are moved. The movement speed at this time is too slow to prevent adhesion and growth of a portion of the raw material on the wall surface. Even if the supply chute from the cyclone is formed into a plurality of chutes to divide the injection, the foregoing problem cannot be overcome, and forming in that the coating is complicated. There has arisen another problem in that both seal air and the air curtain means from the nozzle are able to prevent back flow of grains but they cannot prevent coating because the raw material is dropped by gravitation in a state where the raw material is not dispersed in the air (a fifth problem).

The fluidized bed furnace is, as a general rule, a container that fluidizes granular raw material by a fluid, such as a gas, which is introduced from the bottom portion thereof to cause reactions or heat exchange to take place between the raw material and the fluid. Since the raw material is brought into contact with the gas or the like over a wide surface area in the fluidized bed furnace, an excellent reaction efficiency or the like can be realized as compared with the rotary kiln. Therefore, it has been considered that the fluidized bed furnace has an advantage in reducing the space needed to install the facility, decreasing the needed fuel consumption and preventing generation of harmful exhaust gas. In order to capture granular raw material mixed with the discharge gas to again inject it into the furnace and to realize other purposes, a cyclone is usually connected to a gas discharge port of the fluidized bed furnace. At least a portion of the raw material is charged into the fluidized bed furnace through the foregoing cyclone.

However, the fluidized bed furnace receives the gas under conditions that the raw material can be fluidized, and therefore the pressure in the fluidized bed furnace is higher than that in the cyclone disposed downstream. Therefore, injection of the raw material cannot easily be performed from the cyclone to the fluidized bed furnace. If a raw material supply chute extending downwards from the cyclone is directly connected to the fluidized bed furnace, the gas is introduced (allowed to flow back) from the fluidized bed furnace into the cyclone with the raw material pushed back. What is worse, an upward blow in the cyclone makes the capture of the raw material difficult. The foregoing fact is an inevitable problem occurring due to the characteristic of the fluidized bed furnace arranged in such a manner that granules, each of which has a small size and light weight unit, are charged into the high pressure furnace as the raw material.

Accordingly, the conventional structure is arranged in such a manner that a double opening/closing damper 564 is, as shown in FIG. 38, disposed at an intermediate position of a raw material power supply chute 567 arranged from a cyclone 563 to a fluidized bed furnace 561. While closing at least either of two dampers 564*a* and 564*b* connected in series to prevent the back flow (the blow up) of the gas, they are opened sequentially one by one so that the raw material power is dropped. Specifically, the upper damper 564*a* is opened in a state where the lower damper 564*b* is closed, and then the upper damper 564*a* is closed and the lower damper 564*b* is opened. As a result the raw material is intermittently dropped into the supply chute 567 in such a manner that the capacity between the two dampers 564*a* and 564*b* is the maximum discharge quantity per cycle. Then, the raw material power is charged into the furnace 561 by the gravitation.

The example shown in FIG. 38 shows a portion of a cement clinker manufacturing apparatus disclosed in Japanese Patent Unexamined Publication No. 62-230657. Referring to FIG. 38, reference numeral 561 represents a granulating furnace (although it is a so-called spouted bed type furnace having no perforated plate, it is included in a category of a fluidized bed furnace in a broad sense). Reference numeral 573 represents a sintering furnace (which is as well as a fluidized bed furnace), 563 and 571 represent cyclones, 572 represents a damper, and 574 and 575 represent units for downstream discharging of granules, the discharge units 574 and 575 being known hermetic discharge units (so called "L valves") that realize sealing characteristics by using the granules accumulated therein.

The double opening/closing damper 564 shown in FIG. 38 cannot completely interrupt the gas flowing back from the fluidized bed furnace 561 to the cyclone 563 by way of the chute 567. The reason for this is that a portion of the granules are caught or held in a sealing portion (a space between a valve and a seating surface with which the valve is in contact) in the damper 564 results in the sealing characteristics of the foregoing portion not always being maintained. In particular, the raw material can easily be caught in the sealing portion when the lower damper 564*b* is closed and the upper damper 564*a* is opened to accumulate the raw material therein and then the damper 564*a* is closed after the upper damper 564*a* has been filled with the raw material. If raw material is caught in the sealing portion, a gap is inevitably created adjacent to the raw material thus-caught. As a result, the gas flows backwards through the gap toward the cyclone 563. Therefore, the injection of the raw material into the fluidized bed furnace 561 usually encounters a difficulty or the raw material capturing efficiency deteriorates (a sixth problem).

Cement clinker is manufactured by a method comprising the steps of granulating raw material powder obtained by blending and grinding lime stone, quartz sand, etc. and sintering the granules and cooling the sintered granules. FIG. 32 is a view which illustrates the schematic system of a cement clinker manufacturing apparatus (partially including a new matter) of the foregoing type. Referring to FIG. 32, reference numeral 610 represents a granulating furnace, 603 represents a sintering furnace, and 604 and 605 represent cooling units (coolers) which are arranged as described later. As the granulating furnace 610 and the sintering furnace 603, fluidized bed furnaces as illustrated are widely employed in recent years. The reason for this can be described as follows: the fluidized bed furnace in general exhibits excellent reaction efficiency or the like as compared with a rotary kiln realizes advantages in terms of the facility space reduction and the case of prevention of harmful exhaust gas.

The raw material powder is pre-heated when it is passed through a suspension pre-heater 601, and it ms charged into the granulating furnace 610 so that it is made to be grains (granulated material) each having a diameter of several millimeters while being fluidized. The raw material powder is fluidized by the hot gas and a portion of the grains present adjacent to the surface is melted in the heated state as to be allowed to adhere to one another so that the grains grow to respectively have a predetermined grain size. In this case, the sizes of the grains (that is, sizes of the granulated material) must be made to be adaptable to the specifications of the equipment and the type of the cement. If the size of the granulated material is too large, the usual air quantity (the quantity of hot air supplied from the cooling units 604 and 605) is insufficient to fluidize the granulated raw material in the granulating furnace 610 and the sintering furnace 603 disposed downstream of the granulating furnace 610. As a result, combustion and/or sintering cannot be performed adequately. If the size is too small, adhesion of granules proceeds excessively in the sintering furnace 603, and therefore a undesirable agglomeration takes place.

Since the grain size is varied due to various disturbances, an adequate control means must be employed. Hitherto, the control has been performed by changing the temperature of the fluidized bed 610*a*, the quantity of the raw material powder charged and the time in which the raw material powder (granulated material) is retained in the furnace. Although the mechanism of the granulation has not been determined yet, it has been found from experience that raising of the temperature of the fluidized bed and the lengthening of the retaining time enlarge the grain size and increasing the charged raw material powder reduces the grain size.

The conventional controls involving changing the temperature of the fluidized bed, the quantity of the charged raw material or the retention time in the furnace suffers from unsatisfactory response such that it takes too long time takes from the moment at which the control (the input of the control) is performed to a moment at which the control is effected. Although the response time varies depending upon the type and the capacity of the granulating furnace, it takes two to four hours in a usual cement clinker sintering furnace having a diameter of 2 to 3 m. If the response is unsatisfactorily slow, the quantity of control usually cannot be made adequately. As a result, the control cannot be performed adequately and the control cannot easily be automated. Therefore, a problem arises in that needed operations become too complicated. As well as the process for manufacturing cement clinker, the foregoing problems arise commonly in a variety of cases in which raw material powder is partially melted in a fluidized bed to adhere to one another so as to be granulated so that a predetermined grain size is realized (a seventh problem).

SUMMARY OF THE INVENTION

The first aspect of the present invention is directed to overcome the first problem experienced with the conventional technology and an object of the same is to provide a cement clinker manufacturing apparatus which enables the effect of preventing pollution and an effect of reducing cost to be obtained and which is capable of manufacturing cement clinker having high strength mortar or concrete to be obtained even if sintering is performed at low temperature in such a manner that no flux is added.

In order to achieve the foregoing object, according to an embodiment of a first aspect, there is provided a cement clinker manufacturing apparatus structured as shown in FIG. 1.

The cement clinker manufacturing apparatus is arranged in such a manner that raw material of cement clinker is charged, pre-heated and pre-calcined to manufacture cement clinker, the apparatus being characterized in that the raw material of cement clinker is charged into a quick heating furnace as to be heated at a heated rate of at least 100C.°/ minute and one or more quick heating furnaces are provided.

The quick heating furnace of the cement clinker manufacturing apparatus is able to raise the temperature at least a pre-heating temperature to a sintering reaction temperature.

The quick heating furnace of the cement clinker manufacturing apparatus is capable of heating the raw material of cement clinker to a temperature range from 1300° C. to 1400° C. at a heating rate of at least 100C.°/minute and then maintaining the raw material of cement clinker at the temperature range.

The quick heating furnace of the cement clinker manufacturing apparatus is any one of a furnace selected from a group consisting of a fluidized bed furnace, a spouted bed furnace, a jet fluidized bed furnace, a plasma furnace and an electromelting furnace.

The cement clinker manufacturing apparatus is characterized in that raw material of cement clinker is charged into a sintering furnace by way of one or more quick heating furnaces.

The cement clinker manufacturing apparatus is characterized in that the sintering furnace is a rotary kiln.

The cement clinker manufacturing apparatus is characterized in that the sintering furnace is any one of a furnace selected from a group consisting of a fluidized bed furnace, a spouted bed furnace, a jet fluidized bed furnace, a plasma furnace and an electromelting furnace.

The cement clinker manufacturing apparatus is characterized in that the quick heating furnace is a jet fluidized bed and the sintering furnace is a fluidized bed furnace.

In the cement clinker manufacturing apparatus thus structured, the raw material of cement clinker charged into the quick heating furnace is heated at a heating rate of at least 100 C.°/minute so that it is smoothly heated to a level higher than a melted liquid reaction level and the raw material is subjected to the sintering reaction.

The quick heating furnace of the cement clinker manufacturing apparatus raises the temperature of the charged raw material of cement clinker from the pre-heating temperature (800° C. to 900° C.) in a pre-calciner or the like to the preferred sintering reaction temperature (1300° C. to 1400° C.).

The quick heating furnace of the cement clinker manufacturing apparatus raises the charged raw material of cement clinker to the sintering temperature region of 1300C.° to 1400C.° at a heating rate of at least 100 C.°/minute, and then it maintains the raw material at the foregoing temperature region so that the sintering reaction is allowed to proceed.

By using any one of a furnace selected from a group consisting of a fluidized bed furnace, a spouted bed furnace, a jet fluidized bed furnace, a plasma furnace and an electromelting furnace as the quick heating furnace of the cement clinker manufacturing apparatus, the charged raw material of cement clinker is heated at a heating rate of at least 100 C.°/minute.

The cement clinker manufacturing apparatus is arranged in such a manner that the raw material of cement clinker is charged into the sintering furnace by way of at least one quick heating furnace so that the raw material of cement clinker charged after it has been pre-heated by the pre-calciner or the like is calcined to the sintering temperature region of 1300° C. to 1400° C. at a heated rate of at least 100 C.°/minute by the quick heating furnace, and then the sintering temperature is maintained by the sintering furnace so that cement clinker in which free lime (f-CaO) is reduced is sintered.

Since the cement clinker manufacturing apparatus includes the sintering furnace which is any one of the rotary kiln, the fluidized bed furnace, the spouted bed furnace, the jet fluidized bed furnace, the plasma furnace or the electromelting furnace, the raw material heated to the sintering temperature region by the quick heating furnace is maintained at the sintering temperature of 1300° C. to 1400° C. by the rotary kiln employed as the sintering furnace so that cement clinker is sintered.

Since the quick heating furnace is a jet fluidized bed granulating furnace, charged raw material powder of cement clinker is heated to a molten liquid reaction temperature at a heated rate of at least 100 C.°/minute to granulate the raw material. The thus-obtained granulated material is charged into the foregoing sintering furnace through a discharge chute, and the granulated material is maintained at the sintering temperature of 1300° C. to 1400° C. so that cement clinker is sintered.

An object of a second aspect is to provide an apparatus in which pre-calcined raw material powder is sufficiently dispersed in a low temperature region before it is introduced to a local hot region, and therefore the diameter of the throat can be enlarged while maintaining the granulating performance, the height can be maintained at a predetermined height even if the height of the inverse frustum of a circular cone is enlarged, and the equipment cost can therefore be significantly reduced.

The structure of the second aspect capable of overcoming the second problem experienced with the conventional technology is characterized by a cement clinker manufacturing apparatus arranged in such a manner that raw material powder of cement pre-heated by a pre-heating means such as a suspension pre-heater and pre-calcined by a pre-calcine is charged into a granulating furnace so as to be granulated, the granulated material is charged by way of a discharge chute so as to be sintered into a sintering furnace, and it is cooled by a cooling means before it is recovered, the apparatus being characterized in that a fuel supply means for forming a local hot region is disposed immediately above a distributor disposed in a throat portion between the granulating furnace and the sintering furnace and formed into a porous perforated plate structure to form the granulating furnace into a jet fluidized bed structure, an inverse frustum of a circular cone (a cone portion) capable of causing the granulated material to be formed into a downward moving bed is formed in a lower portion of the jet fluidized bed granulating furnace immediately above the distributor, and means for blowing and supplying the pre-calcined raw material of cement is connected to the side wall of the inverse frustum of circular cone so that the raw material of cement is sufficiently dispersed in the moving bed and then the raw material of cement reaches the local hot region.

Since fuel is blown at a position adjacent to the central portion immediately above the porous perforated distributor disposed in the throat portion to form the local hot region so as to blow the pre-calcined raw material powder of cement into the moving bed through the side wall of the cone portion, the raw material powder is sufficiently dispersed in the moving bed before it reaches the local hot region.

An object of a third aspect is to continuously stably operate a sintering furnace in such a manner that the grain size of granulated material discharged from a granulating furnace is measured and the quantity of air to be forcibly blown to primary and secondary cooling means is controlled in accordance with the measured grain size.

The structure of the third aspect capable of overcoming the third problem experienced with the conventional technology is characterized by a method of operating a sintering furnace in such a manner that material granulated in a jet fluidized bed granulating furnace is discharged and supplied to a fluidized bed sintering furnace, and the cement clinker sintered in the sintering furnace is passed through a primary cooling means or cooler such as a fluidized bed cooler and a secondary cooling means or cooler such as a packed bed cooler or a multi-chamber fluidized bed cooler before it is recovered, the operation method being characterized in that the grain size of granulated material discharged from the granulating furnace is measured, and the quantity of air forcibly blown by the primary and secondary cooling means is controlled in accordance with a measurement result signal denoting that the grain size is deviated from a predetermined grain size range so as to obtain a flow velocity at which no agglomeration is generated in the sintering furnace and no fluidization defect is generated.

An object of a fourth aspect is to prevent coating on the wall surface in the layer of the granulating furnace as to improve the granulating efficiency and to rationally discharge large-size grains while necessitating a simple means.

The structure of the fourth aspect capable of overcoming the fourth problem experienced with the conventional technology is arranged in such manner that the diameter of the outermost nozzle disposed on the porous perforated distributor in the granulating furnace is made smaller than the diameter of a nozzle disposed at the central portion and the diameter of a jet stream discharged from the outermost nozzle is made larger than the nozzle pitch. Further, the large-diameter nozzle is disposed at the central portion of the porous perforated distributor of the granulating furnace, a plurality of small-diameter nozzles are disposed in the periphery of the same, and a fuel blowing nozzle is disposed adjacent no the large-diameter nozzle.

The fourth aspect is able to eliminate a dead zone because the jet diameters interfere with each other in the periphery of the distributor so that coating in the interlayer cone portion is prevented. Since the length of the jet stream is lengthened and it is formed closer to the spouted bed, the granulating performance can be improved. If fuel is blown into the central portion of the distributor to raise the temperature of the central portion, the granulating performance can further be improved. Further, the speed at which the grains drop along the wall surface of the cone portion is increased so that generation of coating is prevented. In addition, large size granulating material generated in the granulating furnace is discharged through the large-diameter nozzle so that abnormal fluidization in the granulating furnace is prevented.

An object of a fifth aspect is to provide an apparatus arranged in such a manner that pre-heated and pre-calcined raw material to be charged and supplied from the lowermost cyclone; forming a suspension pre-heater, into a granulating furnace is blown into the granulating furnace together with pressurized air so that raw material with which no coating will be generated is supplied.

The structure of the fifth aspect capable of overcoming the conventional problem is arranged in such a manner that a raw material injection chute arranged from the lowermost cyclone forming a suspension pre-heater to the fluidized bed granulating furnace is connected to an ejector of a pressurized-air supplying pipe for blowing air to a lower portion of a fluidized bed in the granulating furnace.

An object of a sixth object is to provide an apparatus for injecting raw material for fluidized a bed furnace capable of effectively overcoming back flow of gas to the cyclone and continuously injecting the raw material into the fluidized bed furnace to overcome the foregoing sixth problem.

An apparatus for injecting raw material into a fluidized bed furnace is an apparatus for injecting granular raw material from a cyclone connected to a gas outlet port of the fluidized bed furnace into the fluidized bed furnace, the apparatus being characterized in that (a) a double opening/closing damper is connected to the lower portion of the cyclone, (b) a blowing means for blowing the raw material passed through the damper by compressed gas communicates with the fluidized bed furnace, and (c) a discharging means for interrupting the air communication (the gas flow) between the upstream and the downstream, retaining the raw material and continuously discharging the raw material into the blowing means is disposed between the damper and the blowing means.

The raw material injection apparatus may be arranged in such a manner that (d) the upper portion (between the discharge means and the double opening/closing damper including an adjacent portion having substantially the same pressure) of the discharge means and a gas passage connected to the cyclone are connected to each other by an air pipe.

The discharge means (c) may comprise any one of means selected from a group consisting of the following means.

(c-1) a rotary damper (also called a rotary valve) having a function of crushing coarse grains;

(c-2) a screw conveyer (a paddle screw conveyer, a ribbon screw conveyer and a cut flight screw conveyer included) including an ascending portion in a passage through which the raw material is sent; and (c-3) a container including a gas introduction pipe arranged to pass through the portion for fluidizing the raw material and the bottom portion of the same, a raw material supply chute arranged from an upper portion to the lower portion of the side wall of the same, and a discharge chute connected from the upper portion of the same to the blowing means. Although it is preferable that the same gas is used in the container (c-3) and in the fluidized bed furnace or the blowing means, another gas may be used.

Since the raw material injection apparatus according to the sixth aspect has (a) the double opening/closing damper and (c) the discharge means, back flow of gas from the fluidized bed furnace toward the cyclone can effectively be prevented. Since the discharge means (c) has the characteristics of interrupting the air communication between the upstream and the downstream to compensate the sealing performance of the double opening/closing damper which easily deteriorates due to catching of granular raw material, the foregoing two effects realize satisfactory sealing performance. Since the back flow of the gas can be prevented, injection of the raw material into the fluidized bed furnace can be performed smoothly and the cyclone is able to capture the raw material at an excellent efficiency. If the pressure of the compressed gas for use in the blowing means (b) is raised, no problem takes place because the back flow cannot easily be generated. The fact that the gas pressure can be raised that the raw material can assuredly and ideally be charged into the furnace. If the pressure of the gas in the furnace is raised, the back flow cannot also easily be generated. The fact that the pressure in the furnace can be raised will cause advantages to be realized in that the reaction speed can be increased, the gas volume can be reduced and therefore the size of the furnace can be reduced.

The apparatus according to the sixth aspect enables the raw material to be charged smoothly into the fluidized bed furnace. The reason for this is that the damper (a) causes the raw material to be intermittently discharged to be dropped to the discharge means (c) due to the function of the damper, and the discharge means (c) temporarily retains the raw material thus received to continuously discharge it to the blowing means (b). The blowing means (b) is able to easily blow, into the furnace, the raw material supplied continuously as compared with the case where the raw material is intermittently supplied. Therefore, the blowing means (b) is able to smoothly and, of course, continuously blow the raw material even at a low speed and even with a small quantity of gas. Since a state can be eliminated in which only the compressed gas containing no raw material is blown into the furnace, risks can be eliminated in that the quantity of compressed gas consumption becomes excessively large and that the gas composition and the temperature condition in the furnace become inadequate or unstable.

Since the air pipe (d) makes the pressure at the upper portion of the discharge means (c) and that at the inner portion of the cyclone to be the same level, blowing (the back flow) of the gas toward the lower portion of the cyclone after the gas has passed through the damper (a) can be prevented. Therefore, even if the sealing performance of the apparatus has deteriorated or if the pressure in the furnace is set to a relatively high level, the performance of the cyclone to capture the raw material does not deteriorate. Since the gas passed from the upper portion of the discharge means to the air pipe passes through the air pipe to join the gas passage connected to the cyclone, that is, a normal gas flow from the gas outlet port in the fluidized bed furnace to the cyclone, the capturing performance of the cyclone does not deteriorate. Further, a satisfactory effect is obtained in that raw material mixed with the gas in the air pipe is again captured by the cyclone to be returned to the injection passage into the fluidized bed furnace.

In the apparatus using the rotary damper (c-1) as the discharging means, the rotary damper interrupts the air communication between the upstream and the downstream and temporarily retains the raw material to continuously discharge the raw material. The rotary damper comprises an impeller which is rotated around a horizontal shaft in a cylindrical casing disposed horizontally. Since the gap between the leading portion of the impeller and the internal surface of the casing is small and the raw material is accumulated on the top surface of the impeller and on the internal surface of the casing, the gap is further substantially reduced. As a result, air communication can be interrupted. Further, the thus-accumulated raw material can be continuously discharged by the continuous rotations of the impeller in such a manner that the raw material is swept out. The rotary damper has the function of crushing coarse grains as described in (c-1). Even if coarse grains are included in the raw material, it fines them before it supplies the raw material to the blowing means (b). Therefore, if the blowing means employs a small-diameter pipe to save the gas quantity, clogging can be prevented.

In the apparatus using, as the discharge means, the screw conveyer (c-2), the conveyer performs the foregoing needed operations. That is, since the conveyer has an ascending portion in the passage through which the raw material is conveyed, the raw material is always accumulated. The accumulated raw material realizes a so-called material sealing effect with which the air communication between the upstream portion and the downstream portion is interrupted. Since the raw material is caused to be accumulated as described above and the screw is continuously rotated, the raw material is, of course, discharged. If the paddle screw conveyer, the ribbon screw conveyer or the cut flight screw conveyer is used as the screw conveyer, or if an ordinary screw conveyer is used, coarse grains cannot easily be discharged in a case where a gap is present between the internal surface of the casing and the screw body. Therefore, clogging of the pipe of the bowing means can be prevented. It is preferable that coarse grains that are not discharged are periodically discharged.

In the apparatus including the container (c-3), the container serving as the discharge means acts as follows: the raw material supplied from the damper (a) is first accumulated in the raw material supply chute in which it exhibits the sealing performance (the material seal) of the raw material. As a result, the raw material interrupts the air communication between the damper (a) disposed upstream and a portion downstream from the raw material supply chute. In the fluidizing portion, the gas introduced from the bottom portion through the gas introducing pipe fluidizes the foregoing raw material, and then the raw material flows over the upper discharge pipe as to be continuously discharged. Coarse grains are not fluidized but they are accumulated in the bottom portion of the fluidizing portion, the coarse grains being, for example, periodically discharged. Therefore, a problem in that the blowing means encounters clogging can be prevented.

An object of a seventh aspect is to overcome the seventh problem and to provide a reliable method of controlling the grain size which exhibits excellent response and to provide a jet fluidized bed furnace in which the foregoing control method can easily be embodied.

The method of controlling the grain size according to the seventh aspect is a method of controlling the grain size adapted to a fluidized bed furnace (a fluidized bed furnace in a broad sense including a so-called spouted bed furnace and a jet fluidized bed furnace) for realizing a predetermined grain size by partially melting raw material powder to cause them adhere to one another while fluidizing the raw material powder, the method comprising the steps of: (a) using compressed gas to blow the raw material powder into the fluidized bed furnace; and (b) changing blowing conditions to control the grain size. The blowing conditions are (1) the height at which the raw material powder is blown (for example, the height from the top surface of the distributor in the furnace to the blowing port), (2) the number of blowing positions, (3) the blowing angle (the direction), (4) the quantity of the gas to be blown (the ratio of the quantity of the raw material powder and the quantity of the gas, that is, the solid-gas ratio), and (5) the blowing speed.

The fluidized bed granulating furnace according to the seventh embodiment is a fluidized bed furnace (a spouted bed furnace and a jet fluidized bed furnace included) for melting a portion of the raw material powder to be allowed to adhere to one another while fluidizing raw material powder so that a predetermined grain size is realized, the fluidized bed granulating furnace being structured to be adaptable to the foregoing control method.

The fluidized bed furnace according to the seventh aspect is arranged in any one of the following manners that:

a plurality of means for blowing raw material powder by using compressed gas are, while including means which can be changed to perform blowing and stopping blowing, disposed vertically on the side wall of the fluidized bed furnace at intervals;

a plurality of similar means for blowing raw material powder by using compressed gas are, while including means which can be changed over to perform blowing and stopping blowing, disposed in the circumferential direction on the side wall of the fluidized bed furnace at intervals;

similar blowing means is disposed on the side wall of the fluidized bed furnace in such a manner that the blowing angle can be varied (vertically and/or horizontally); or similar blowing means is disposed on the side wall of the fluidized bed furnace in such a manner that the quantity of the compressed gas can be varied.

If raw material powder is blown into the hot fluidized bed furnace in accordance with the grain size control method according to the seventh aspect and if the flowing conditions are changed, the grain size in the fluidized bed furnace can be controlled while exhibiting quick response. As a result, granulated material exhibiting satisfactorily equal grain size can easily be obtained.

Although the mechanism for determining the grain size has not been determined yet, an estimation can be made that the change of the blowing conditions quickly affects the grain size results from the fact that grains serving as the core of the granulated material immediately increases or decreases as follows. That is, if raw material powder is blown into the fluidized bed furnace, the change of the blowing conditions enables the state of the raw material powder dispersion in the furnace to easily and quickly be controlled as compared with a case where the raw material powder is dropped by gravitation. Since the core is formed by some raw material grains melted and allowed to adhere to one another, the state of the dispersion of the raw material powder directly determines the number of cores that can be formed. If raw material powder is present in a dense manner, the number of cores increases. If the raw material powder is dispersed, the number of the cores decreases. If a predetermined quantity of product is maintained, the fact that the number of the cores is large results in small size granulated grains which are formed by fluidized raw material further allowed to adhere to the cores. If the number of the cores is small, the size of each granulated material is enlarged. Therefore, the conditions under which the raw material powder is blown enable the grain size to easily be controlled. If raw material powder is so blown that it is widely dispersed in the fluidized bed, the number of generated cores is decreased, causing the grain size to be enlarged. If the raw material powder is so blown as to be gathered adjacently, a large number of cores is generated, causing the grain size to be reduced.

As a result of experiments performed by the inventors of the present invention, the change of the blowing position as performed in (1) resulted in values shown in FIG. 31A (to be described later). That is, when blowing was performed at a low position (adjacent to the top surface of the distributor, and therefore at a position at which the jetting speed of the fluidized gas supplied from the nozzle is high), large grain size was realized. When blowing was performed at a high position away from the distributor, small grain size was realized. The foregoing facts substantiate the estimation that blowing performed at a position in which the gas flow velocity is high, that raw material powder is dispersed by the gas and therefore the number of cores decreases, causing the grain size to be enlarged and that a contrary case results in an increase in the number of cores, causing the grain size to be reduced.

If the number of blowing points is changed as described in (2), the state (therefore, the state where raw material powder is dispersed which determines the number of generated cores) of blowing at each position is changed causing the grain size to be changed even if the quantity of production is maintained by injecting a predetermined total quantity of raw material powder per time. Further, the change of the blowing direction (3), the quantity of gas to be blown (4) or blowing speed (5) immediately changes the degree of the dispersion of raw material powder. As a result, the grain size is quickly changed. In any case, the grain size is enlarged in proportion to the degree of dispersion of raw material powder in the fluidized bed furnace.

The fluidized bed granulating furnace according to the seventh aspect is structured so that the change of height of the blowing position can easily be performed. A plurality of means for blowing raw material powder are vertically disposed on the side wall of the fluidized bed furnace at intervals, the plural means including means which can be changed over between the blowing operation and stoppage of the blowing operation. Therefore, the raw material powder can be blown while changing the height (or changing the combination of heights) of the blowing position. As a result, a change of the grain size of the foregoing type (for example, as shown in FIG. 31A) can quickly be performed. Therefore, granulation can be so realized by performing the control with excellent response that an excellent grain size accuracy (that is, irregular grain size can be prevented) is exhibited. Further, the fluidized bed furnace according to the seventh aspect is arranged in such a manner that the number of the blowing positions can easily be changed as described in (2) so that the control of the grain size with excellent response is performed. If the state of fluidization in the furnace is not axial symmetry (fluidization of raw material powder is not made uniformly in the circumferential direction due to, for example, the configuration of the burners in the furnace), the grain size control can sometimes be performed by changing the position (that is, the blowing means) while maintaining the number of the blowing positions.

The grain size can be controlled by changing the blowing angle (direction) as described in (3). If the angle is changed in a perpendicular plane from the side wall of the furnace, the target of blowing of the raw material powder can adequately be selected from positions, for example, the portion adjacent to the distributor and in which the gas flow velocity is high and the upper portion in which the gas flow velocity is low. As a result, the state of the dispersion can arbitrarily be changed. Since the state of fluidization in the fluidized bed and the temperature condition in the same are usually non-uniform in the radial direction in the furnace, the grain size can usually be controlled by changing the angle in the horizontal plane. Further, the change of the quantity of gas to be blown as described in (4) or the change of the blowing speed as described in (5) will change the state of dispersion of raw material powder to control the grain size.

Other and further objects, features and advantages of the invention will be appear more fully from the following description.

BRIEF DESCRIPTION OF THE DRAWINGS

FIGS. 22A and 22B illustrate a first embodiment of a sixth aspect of the present invention, wherein FIG. 22A is a schematic view which illustrates a fluidized bed furnace and the overall structure of a raw material injection apparatus, and FIG. 22B is a detailed cross sectional view which illustrates only a rotary damper (a discharge means) of the raw material injection apparatus;

FIGS. 23A and 23B illustrate a second embodiment of the sixth aspect of the present invention, wherein FIG. 23A is a cross sectional view which illustrates a screw conveyer for use as a discharge means of a raw material injection apparatus, and FIG. 23B is a side elevational view which illustrates the same;

FIGS. 25A and 25B illustrate a fourth embodiment of the sixth aspect of the present invention, wherein FIG. 25A is a cross sectional view which illustrates a paddle screw conveyer for use as a discharge means of a raw material injection apparatus, and FIG. 25B is a side elevational view which illustrates the same;

DESCRIPTION OF THE PREFERRED EMBODIMENTS

First Aspect of the Present Invention

An embodiment of a first aspect of the present invention will now be described with reference to the drawings.

Structure of a First Embodiment

Figure 1:
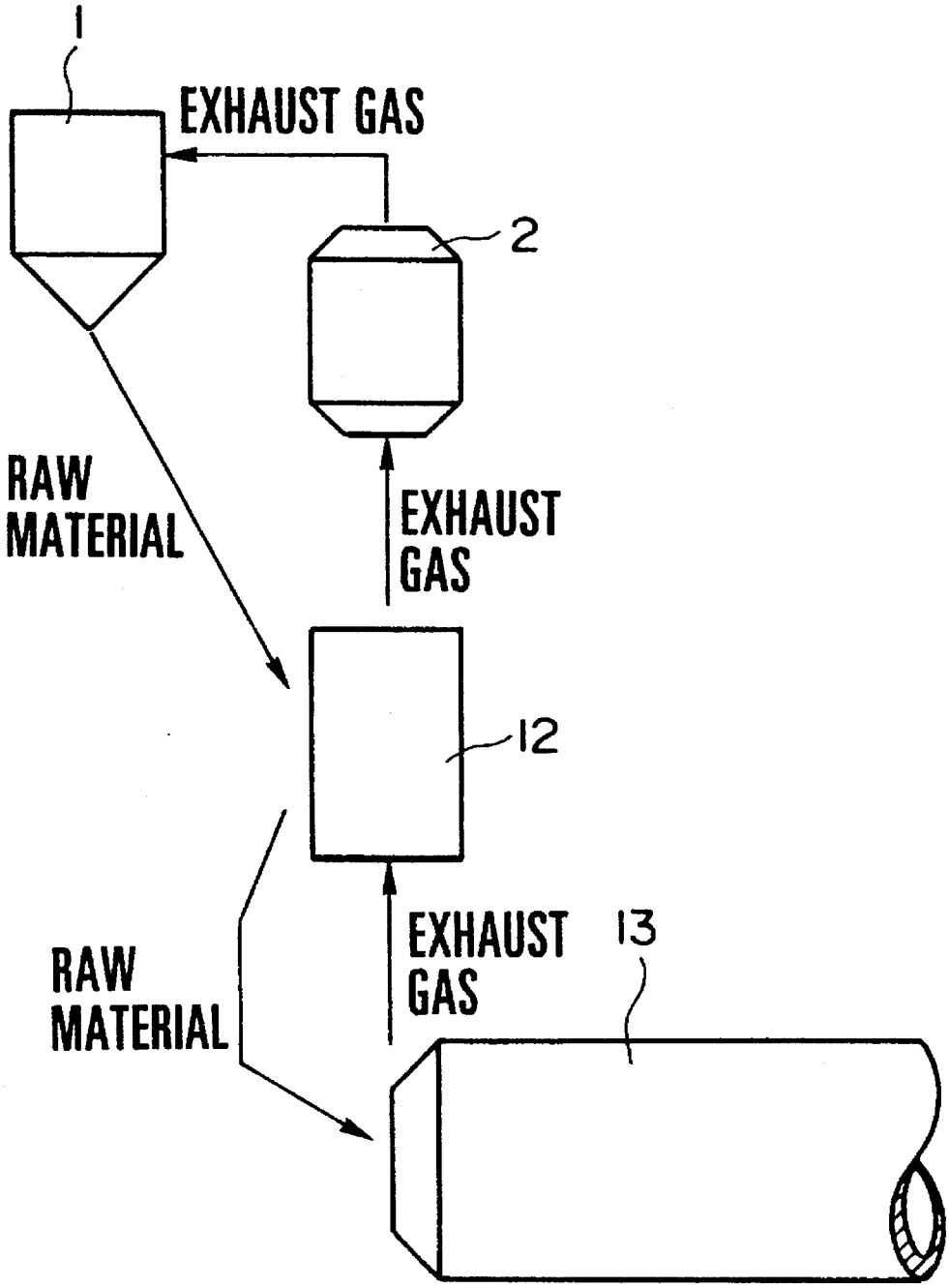
FIG. 1 is a block diagram which illustrates a first embodiment of a cement clinker manufacturing apparatus according to a first aspect of the present invention.
Figure 2:
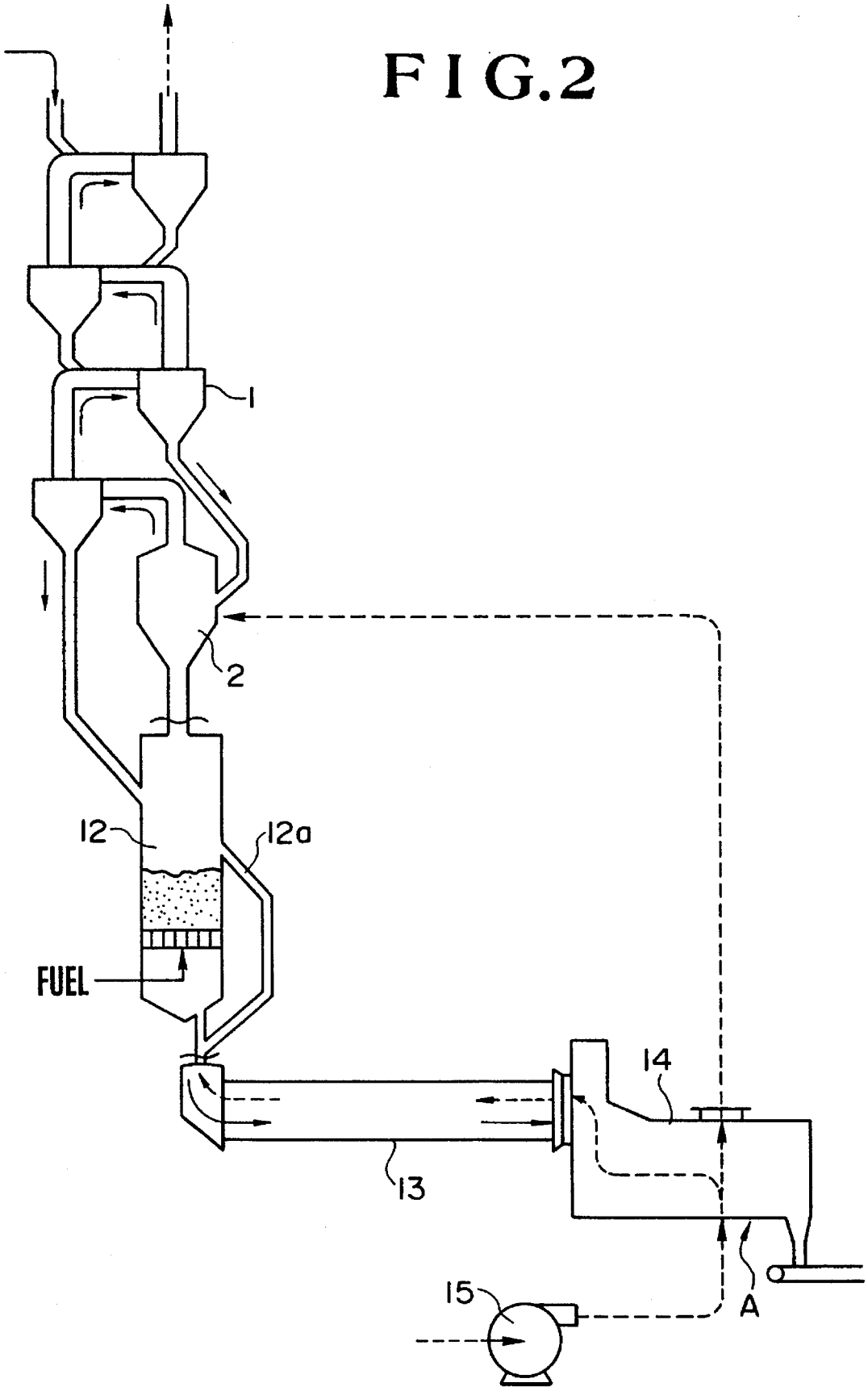
FIG. 2 is a structural view which illustrates the first embodiment of the cement clinker manufacturing apparatus according to the first aspect of the present invention.

A first embodiment of a cement clinker manufacturing apparatus comprises a fluidized bed furnace serving as a quick heating furnace and a rotary kiln serving as a sintering furnace. The block diagram of the apparatus is shown in FIG. 1, and the apparatus structure is shown in FIG. 2.

The cement clinker manufacturing apparatus according to the first embodiment comprises a pre-heating unit 1 formed by a plurality of pre-heating furnaces combined with one another, a pre-calciner 2 for pre-calcining the pre-calcined raw material to heat it to about 800° C. to 900° C., a quick heating furnace 12 for heating the pre-heated raw material to 1300° C. to 1400° C. at a heating rate of at least 100 C.°/minute after the pre-calcined raw material has been charged, and a sintering furnace 13 for maintaining the raw material temperature of 1300° C. to 1400° C. for a predetermined time period to sinter and cause the raw material to react after the quickly heated raw material has been charged.

The sintered cement clinker is conveyed to a clinker cooler 14 as to be cooled with cooling air supplied from an air supplier 15.

Air supplied from the air supplier 15 is heated in the clinker cooler 14 so that its temperature is raised, and then air is branched into an air flow from the clinker cooler 14 to the sintering furnace 13 and that toward the pre-calciner 2. The air flow from the clinker cooler 14 to the sintering furnace 13 is further heated in the sintering furnace 13 so that its temperature is raised. Then, the hot air is sent to the quick heating furnace 12 connected to the sintering furnace 13 so that it is used as fluidizing hot air for fluidizing the raw material accumulated in the quick heating furnace 12 and as combustion air. The air flow branched at the clinker cooler 14 toward the pre-calciner 2 is used as pre-calcining gas and combustion air.

The quick heating furnace 12 forms a fluidized bed furnace as shown in FIG. 2. The quick heating furnace 12 is arranged in such a manner that the raw material supplied from the pre-calciner 2 is charged through the side wall portion, the heating air for fluidizing powder, supplied from the sintering furnace 13, is introduced thereto, fuel is introduced thereto through the side portion of the lower portion thereof to be sintered, powder for fluidizing the combustion gas is allowed to pass through to heat the powder, and the raised powder is, with the air flow, sent to the sintering furnace 13 through a discharge pipe 12*a* disposed at the central portion of the side wall.

The quick heating furnace 12 has a heat raising performance of 100° to 200 C.°/minute as to be capable of heating the raw material to 1400° C.

The sintering furnace 13 comprises a rotary kiln having a shortened length to correspond to the processing time which corresponds to the time lapse needed by the quick heating furnace 12. The sintering furnace 13 is used to perform only a sintering reaction process such that it is operated to always maintain a desireable processing temperature (the highest temperature≦ 1400° C.).

Since the processing temperature in the sintering furnace 13 can be lowered, the quantity of cooling air to be supplied to the clinker cooler 14 can be reduced. Therefore, the needed cooling performance can be reduced as compared with the conventional structure.

Operation of the First Embodiment

In the first embodiment thus-structured, the raw material for cement clinker is pre-heated by the pre-heating unit 1, and it is pre-calcined by raising the temperature to 800° to 900° C. in the pre-calciner 2. Then, the raw material for cement clinker is charged into the quick heating furnace 12. In the quick heating furnace 12, hot air is introduced through the lower portion thereof and fuel is introduced through the side portion of the lower portion thereof so that the fuel and air are mixed with each other before they are sintered. The powder accumulated in the furnace is fluidized by the hot air introduced and the combustion gas, and the powder is heated to the desired processing temperature of 1300° C. to 1400° C. at a heating rate of 100° to 200 C.°/minute. The raised powder is brought into the flow of the gas to be discharged through a discharge pipe 12*a* disposed at the central portion of the side wall. As a result, the powder is conveyed to the sintering furnace 13 connected to the quick heating furnace 12. In the sintering furnace 13 into which the quickly heated raw material has been introduced, the temperature is continuously maintained at 1300° C. to 1400° C. so that the sintering reaction is continued until the content of free time (f-CaO) is lowered to a predetermined range.

Effect of the First Embodiment

Since the quick temperature rise realized in the first embodiment enables the sintering reactions to proceed quickly, the sintering temperature can be lowered by about 100° to 200° C. Therefore, the highest sintering temperature can be lowered as compared with the conventional structure. As a result, the heat consumption can be reduced by 3 to 5% and the quantity of the generated nitride and oxide can be reduced by 20 to 30%.

Structure of a Second Embodiment

Figure 3:
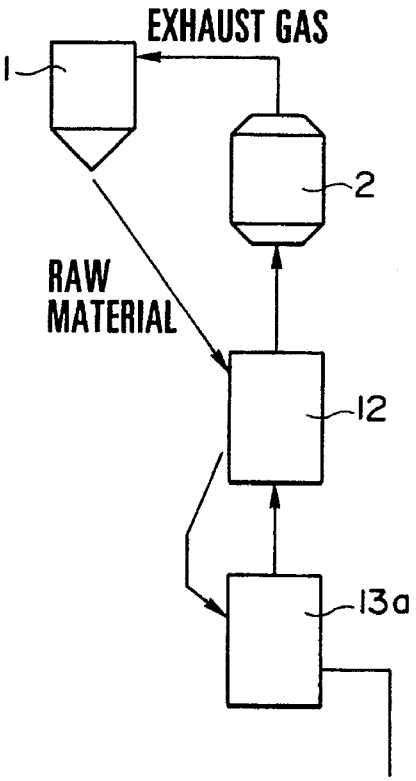
FIG. 3 is a block diagram which illustrates a second embodiment of the cement clinker manufacturing apparatus according to the first aspect of the present Invention.

A second embodiment of the cement clinker manufacturing apparatus comprises a fluidized bed furnace serving as the quick heating furnace and another fluidized bed furnace serving as the sintering furnace. The block diagram of the apparatus according to this embodiment is shown in FIG. 3.

The cement clinker manufacturing apparatus according to the second embodiment comprises a pre-heating unit 1 formed into a plural-stage structure consisting of pre-heating furnaces combined with one another, a pre-calciner 2 for heating the pre-heated raw material to about 800° C. to 900° C. to pre-calcine the raw material, a quick heating furnace 12 having the same performance as that according to the first embodiment with which the pre-calcined raw material can be raised to 1300° C. to 1400° C. at a heating rate of at least 100 C.°/minute, and a fluidized bed sintering furnace 13*a* for maintaining the temperature of the quickly heated raw material at 1300° C. to 1400° C. for a predetermined period to cause the sintering reaction to be continued.

The fluidized bed sintering furnace 13*a* is a similar type apparatus to the quick heating furnace 12 and it is used to perform only the sintering reaction process while being operated to always maintain the temperature at an aimed processing temperature (the highest temperature≦1400° C.).

Cement clinker sintered in the fluidized bed sintering furnace 13*a* is conveyed to a clinker cooler (omitted from illustration), and then it is cooled to a predetermined temperature by cooling air supplied from an air supplier (omitted from illustration).

Operation of the Second Embodiment

In the second embodiment thus-structured, the raw material for cement clinker is pre-heated by the pre-heating unit 1, and it is pre-calcined by raising the temperature to 800° to 900° C. in the pre-calciner 2. Then, the raw material for cement clinker is charged into the quick heating furnace 12. In the quick heating furnace 12, hot air is introduced through the lower portion thereof and fuel is introduced through the side portion of the lower portion thereof so that the fuel and air are mixed with each other before they are sintered. The powder accumulated in the furnace is fluidized by the introduced hot air and the combustion gas, and the powder is heated to the desired processing temperature of 1300° C. to 1400° C. at a heating rate of 100° to 200 C.°/minute. The heated powder is brought into the flow of the gas to be discharged through a discharge chute (omitted from illustration) disposed at the central portion of the side wall. As a result, the powder is conveyed to the fluidized bed sintering furnace 13*a* connected to the quick heating furnace 12. In the fluidized bed sintering furnace 13*a* into which raw material for cement clinker has been introduced, the temperature is continuously maintained at 1300° C. to 1400° C. so that the sintering reaction is continued until the content of free lime (f-CaO) is lowered to a predetermined range.

Effect of the Second Embodiment

Since the quick temperature rise realized in the first embodiment enables the sintering reactions to proceed quickly as compared with the conventional structure, the highest sintering temperature can be lowered. As a result, the quantity of the generated nitride and oxide can be reduced. Further, the employment of the fluidized bed sintering furnace 13*a* to serve as the sintering furnace enables a further precise temperature control as compared with the case in which the rotary kiln is used. Therefore, the component adjustment can easily be performed.

Structure of a Third Embodiment

Figure 4:
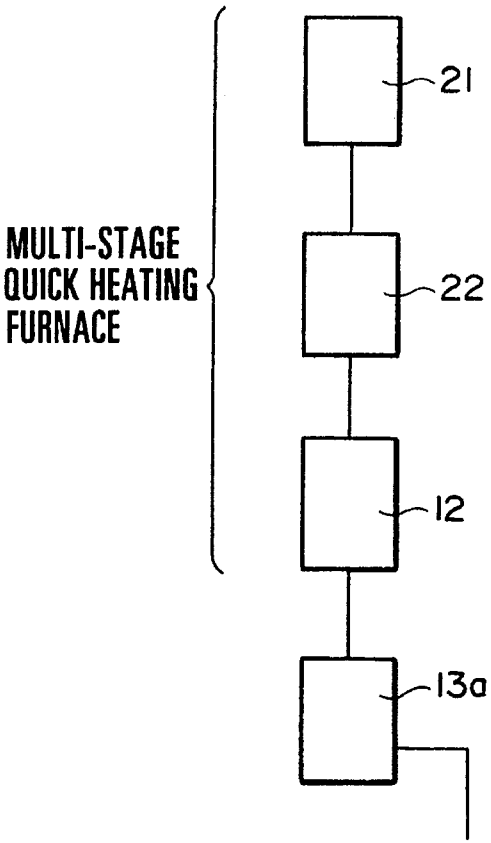
FIG. 4 is a block diagram which illustrates a third embodiment of the cement clinker manufacturing apparatus according to the first aspect of the present invention.

A third embodiment of the cement clinker manufacturing apparatus is formed into a multi-stage quick heating furnace consisting of a pre-heating unit, a pre-calciner and a quick heating furnace each of which comprise a fluidized bed furnace. The block diagram of the apparatus is shown in FIG. 4.

The cement clinker manufacturing apparatus according to the third embodiment comprises a pre-heating fluidized bed furnace 21 for pre-heating raw material for cement clinker, a fluidized bed furnace 22 for heating the pre-heated raw material to about 800° C. to 900° C. to pre-calcining it, a quick heating furnace 12 for heating the pre-calcine material to 1300° C. to 1400° C. at a heated rate of at least 100 C.°/minute, and fluidized bed sintering furnace 13*a* that maintains the temperature of the quickly heated raw material at 1300° C. to 1400° C. for a predetermined time to cause the sintering reaction to be continued.

The fluidized bed sintering furnace 13*a* is a similar type apparatus to the quick heating furnace 12 and it is used to perform only the sintering reaction process while being operated to always maintain the temperature at an aimed processing temperature (the highest temperature≦1400° C.).

Cement clinker sintered in the fluidized bed sintering furnace 13*a* is conveyed to a clinker cooler (omitted from illustration), and then it is cooled to a predetermined temperature by cooling air supplied from an air supplier (omitted from illustration).

Operation of the Third Embodiment

In the third embodiment thus-structured, the raw material for cement clinker is pre-heated by the fluidized bed pre-heating furnace 21, and it is pre-calcined by raising the temperature to 800° to 900° C. in the fluidized bed furnace 22 for pre-calcining. Then, he raw material for cement clinker is charged into the quick heating furnace 12. In the quick heating furnace 12, hot air is introduced through the lower portion thereof and fuel is introduced through the side portion of the lower portion thereof so that the fuel and air are mixed with each other before they are sintered. The powder accumulated in the furnace is fluidized by the hot air introduced and the combustion gas, and the powder is heated to the desired processing temperature of 1300° C. to 1400° C. at a heating raising rate of 100° to 200 C.°/minute. The heated powder is brought onto the flow of the gas to be discharged through a discharge chute (omitted from illustration) disposed at the central portion of the side wall. As a result, the powder is conveyed to the fluidized bed sintering furnace 13*a* connected to the quick heating furnace 12. In the fluidized bed sintering furnace 13*a* into which raw material for cement clinker has been introduced, the temperature is continuously maintained at 1300° C. to 1400° C. so that the sintering reaction is continued until the content of free lime (f-CaO) is lowered to a predetermined range.

Effect of the Third Embodiment

Since the quick temperature rise realized in the third embodiment enables the sintering reactions to proceed quickly as compared with the conventional structure, the highest sintering temperature can be lowered. As a result, the heat consumption quantity can be reduced and the quantity of the generated nitride and oxide can be reduced. Further, the arrangement is made in such a manner that all fluidized bed pre-heating furnace 21, the fluidized bed furnace 22 for pre-calcining, the quick heating furnace 12 and the fluidized bed sintering furnace 13*a* are made of the fluidized bed furnace to form the multi-stage apparatus consisting of the same type apparatuses. Therefore, the respective furnaces can easily be controlled and further precise temperature control can be performed. As a result, energy saving can be enhanced, the pollution prevention effect can be improved and the adjustment of the cement clinker component can easily be performed.

Structure of a Fourth Embodiment

Figure 5:
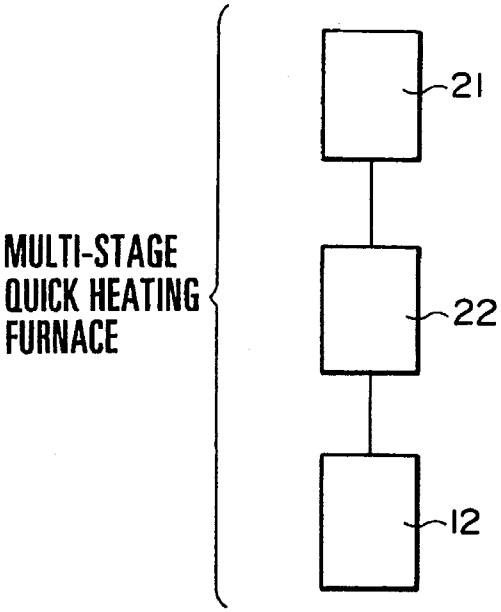
FIG. 5 is a block diagram which illustrates a fourth embodiment of the cement clinker manufacturing apparatus according to the first aspect of the present invention.

A fourth embodiment of the cement clinker manufacturing apparatus is arranged in such a manner that the roles of the quick heating furnace and the fluidized bed sintering furnace according to the third embodiment are performed by a single fluidized bed furnace to form a multi-stage quick heating furnace. The block diagram of the apparatus according to this embodiment is shown in FIG. 5.

The cement clinker manufacturing apparatus according to the third embodiment comprises a fluidized bed pre-heating furnace 21 for pre-heating raw material for cement clinker, a fluidized bed pre-calcining furnace 22 that heats the pre-heated raw material to 800° C. to 900° C. to pre-calcine it, and a quick heating furnace 12 that heats the pre-calcined raw material to the desired processing temperature of 1300° C. to 1400° C. at a heating rate of 100° C. to 200 C.°/minute and maintains the aimed processing temperature for a predetermined time to cause the sintering reaction to be continued. The residual arrangements are the same as those according to the third embodiment.

Operation of the Fourth Embodiment

In the fourth embodiment thus-structured, the raw material for cement clinker is pre-heated by the fluidized bed pre-heating furnace 21, and it is pre-calcined in the fluidized bed furnace 22 for pre-calcining. Then, the raw material for cement clinker is charged into the quick heating furnace 12. In the quick heating furnace 12, the pre-calcined raw material is heated to 1300° C. to 1400° C. at a heating rate of at least 100 C.°/minute so that the sintering reaction is continued until the content of free lime (f-CaO) is lowered to a predetermined range.

Effect of the Fourth Embodiment

The quick temperature rise realized in the fourth embodiment enables the sintering reactions to proceed quickly as compared with the conventional structure. Further, the sintering temperature can be maintained and the highest sintering temperature can be lowered. Therefore, the heat consumption quantity can be reduced and the quantity of nitride and oxide can be reduced further effectively as compared with the first to the third embodiments. Since the structure is arranged in such a manner that all furnaces comprise the fluidized bed furnaces, the same type apparatuses are disposed to form the multi-stage structure and the number of the apparatuses is decreased, facility cost can be reduced. Further, the respective furnaces can further easily be controlled as compared with the third embodiment.

The apparatus for manufacturing cement clinker is characterized in that the quick heating furnace is a granulating furnace for granulating the raw material for cement clinker in which granulated material is charged into a sintering furnace by way of a discharge chute. In the above apparatus, it is preferable that the granulating furnace is a jet fluidized bed furnace and the sintering furnace is a fluidized bed furnace.

Other Embodiments

The structures of the apparatuses according to the foregoing embodiments are only preferred examples, and therefore modifications may be made. Therefore, another apparatus structure may be employed. For example, spouted bed furnaces, jet fluidized bed furnaces, plasma furnaces and electromelting furnaces may be arbitrarily selected as well as the fluidized bed furnaces to meet the purpose of use so far as the performance and the economical advantages can be obtained.

Effect of the First Aspect

As described above, the cement clinker manufacturing apparatus according to the first aspect of the present invention comprises one or more quick heating furnace 12 for heating the raw material for cement clinker at a heating rate of at least 100 C.°/minute so that the raw material for cement clinker charged into the quick heating furnace 12 can quickly be heated to a level higher than a molten fluid reaction temperature to proceed to the sintering reaction. Therefore, the quality of the cement clinker can be improved even if sintering is performed without flux added. Further, the heat consumption quantity can be reduced, and therefore the operation cost can be reduced while decreasing generation of pollution substances, such as nitrides and oxides.

Since the foregoing cement clinker manufacturing apparatus is able to raise the temperature at least from the pre-heating level to the sintering reaction level by the quick heating furnace 12 thereof, the raw material for cement clinker charged into the quick heating furnace 12 can be efficiently heated by the pre-calciner or the like from the temperature (800° C. to 900° C.) to which the raw material for cement clinker is pre-heated to the desired temperature (1300° C. to 1400° C.) needed for the sintering reaction. Therefore, the heat efficiency can be improved.

The foregoing cement clinker manufacturing apparatus is arranged in such a manner that the quick heating furnace 12 heats the charged raw material for cement clinker to the sintering reaction temperature ranging from 1300° C. to 1400° C. at a heating rate of at least 100 C.°/minute and it is able to maintain the raw material for cement clinker at the foregoing temperature range. Therefore, the raw material for cement clinker can be retained in the quick heating furnace 12 until a predetermined sintering reaction proceeds. As a result, sintering of cement clinker can be efficiently be performed at a lower temperature as compared with that needed for the conventional structure while maintaining higher quality.

The cement clinker manufacturing apparatus comprises, as the quick heating furnace 12, any one of the fluidized bed furnace, the spouted bed furnace, the jet fluidized bed furnace, the plasma furnace or the electromelting furnace. Therefore, the temperature can be raised at the heating rate of at least 100 C.°/minute, which has not been realized by the single rotary kiln of the conventional sintering apparatus. As a result, the process can quickly proceed to the sintering process.

Since the cement clinker manufacturing apparatus is arranged in such a manner that the raw material for cement clinker is charged into the sintering furnace 13, **13*a* by way of one or more quick heating furnaces 12, the raw material for cement clinker charged after it has been pre-heated by the pre-calciner or the like can be heated to the sintering temperature ranging from 1300° C. to 1400° C. at the heating rate of at least 100° C./minute and then the sintering temperature is maintained by the sintering furnace 13,13*a***. As a result, the sintering reaction can be efficiently continued, and therefore cement clinker containing free lime (f-CaO) by a satisfactorily reduced quantity can be sintered.

Since the cement clinker manufacturing apparatus includes the sintering furnace 13,**13*a* comprising a furnace selected from a group consisting of the rotary kiln, the fluidized bed furnace, the spouted bed furnace, the jet fluidized bed furnace, the plasma furnace and the electromelting furnace, the raw material which has been heated to the sintering temperature range by the quick heating furnace 12** can be maintained at the sintering temperature of 1300° C. to 1400° C. by any one of the rotary kiln, the fluidized bed furnace, the spouted bed furnace, the jet fluidized bed furnace, the plasma furnace or the electromelting furnace to sinter the cement clinker. Therefore, cement clinker can be sintered at a lower temperature as compared with the conventional temperature while maintaining high quality. Further, the sintering reaction process can be performed while saving energy and preventing pollution.

Second Aspect of the Present Invention

A second aspect of the present invention will now be described with reference to the drawings.

Figure 6:
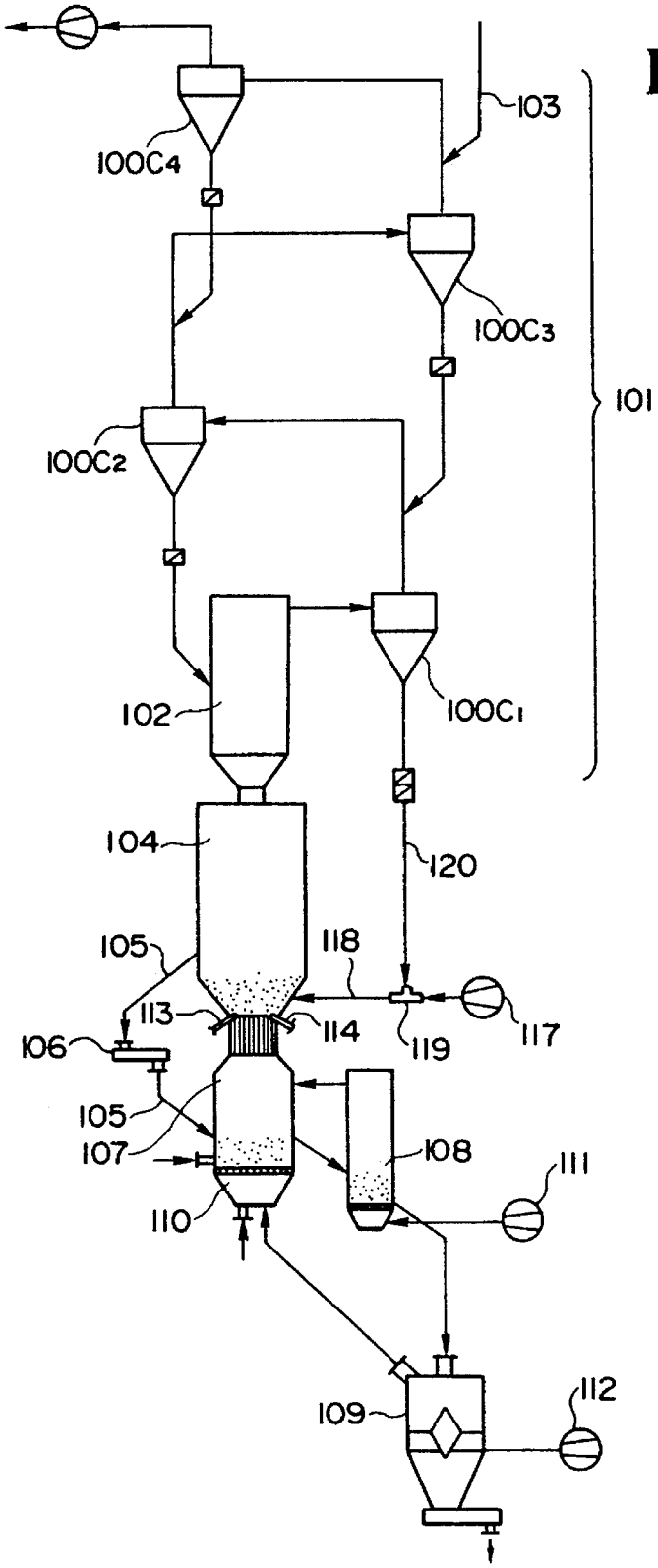
FIG. 6 is a flow chart adapted to an apparatus according to a second aspect of the present invention.
Figure 7:
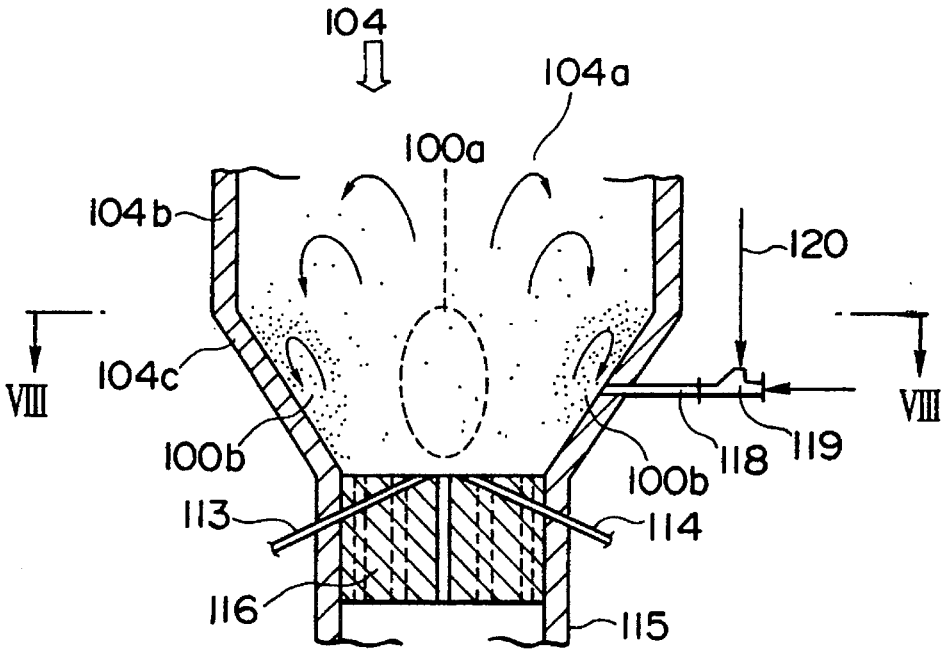
FIG. 7 is a cross sectional view which illustrates an essential portion of a spouted bed granulating furnace.
Figure 8:
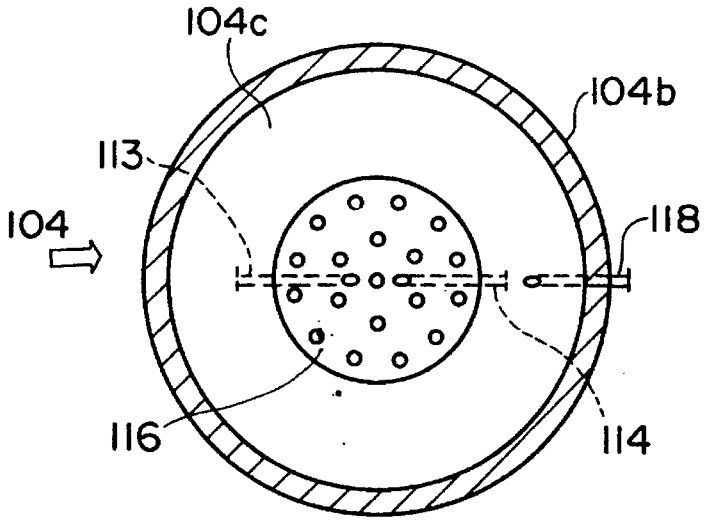
FIG. 8 is a cross sectional view taken along line VIII—VIII of FIG. 7.

FIG. 6 is a flow sheet of the apparatus according to the present invention, FIG. 7 is a cross sectional view which illustrates an essential portion of a jet fluidized bed granulating furnace, and FIG. 8 is a cross sectional view taken along line VIII—VIII of FIG. 7.

Referring to FIG. 6, the overall system of the apparatus will now be described. Reference numeral 101 represents a suspension pre-heater. The suspension pre-heater 101 comprises cyclones $\mathbf{100C_1}$, $\mathbf{100C_2}$, $\mathbf{100C_3}$, $\mathbf{100C_4}$ and pre-calciner 102. Raw material powder for cement charged into the system through a raw material injection chute 103 is pre-heated when it is conveyed through the cyclones $\mathbf{100C_4}$, $\mathbf{100C_3}$, $\mathbf{100C_2}$, the pre-calciner 102 and the cyclone $\mathbf{100C_1}$, in this sequential order. Then, the raw material powder for cement is charged into a granulating furnace 104. Granulated material size-refined in the granulating furnace 104 is, by way of an L-valve (a hermetic discharge unit) 106, charged into a fluidized bed sintering furnace 107 from a discharge chute 105 formed into an overflow structure. Then, the raw material powder for cement is sintered in the fluidized bed sintering furnace 107, subjected to a primary cooling in a fluidized bed cooler 108, and then subjected to a secondary cooling in a packed bed cooler 109 so that it is recovered as cement clinker.

Hot air from the fluidized bed cooler 108 is recovered by the connected upper portion of the fluidized bed sintering furnace 107, while hot air from the packed bed cooler 109 is recovered by a wind box 110 of the fluidized bed sintering furnace 107. Reference numerals 111 and 112 represent forced blowers, 113 represents a pulverized coal supply line, and 114 represents a heavy oil burner. The second aspect is arranged in such a manner that the cement clinker manufacturing apparatus constituted as described above comprises the granulating furnace 104 modified as follows.

Referring to FIGS. 7 and 8, the granulating furnace 104 will now be described. A porous perforated (the diameter of each perforation being 20 to 100 mm) distributor 116 is disposed in the upper portion of a throat 115 vertically connecting the granulating furnace 104 and the fluidized bed sintering furnace 107 to each other. The pulverized coal supply line 113 and the heavy oil burner 114 are disposed to face each other at a position adjacent to the central portion of the upper surface of the distributor 116 so that a local hot region 100*a* is formed at the central portion of a space immediately above the distributor 116. On the other hand, the granulating furnace 104 is composed of a cylindrical portion 104*b* forming a free board 104*a* and an inverse frustum of circular cone (cone portion) 104*c*, the temperature of which is lower than that at the local hot region 100*a*, in which the granulated material is able to form a downward moving bed 100*b* as designated by an arrow and the height of which is substantially the same as that of the fluidized bed. That is, the granulating furnace 104 is formed into a structure which serves as both spouted bed and a fluidized bed.

The side wall of the cone portion 104*c* formed in the jet fluidized bed granulating furnace 104 constituted as described above receives an end of a supply line 118 for supplying pre-heated raw material for cement, the supply line 118 having a forced blower 117 on another end thereof. Further, an ejector 119 is interposed at an intermediate position of the supply line 118, the ejector 119 being connected to a raw material powder supply chute 120 suspended from the cyclone 100C. The structure is constituted in such a manner that the pressurized gas of the forced blower 117 blows raw material powder to be supplied into the moving bed 100*b* formed in the cone portion 104*c*. In this structure, the raw material to be supplied by blowing can be sufficiently dispersed in the moving bed 100*b* as to cause the raw material powder to reach the local hot region 100*a*.

Effect of the Second Aspect

As described above, the structure of the second embodiment enables the following effects to be obtained.

(a) In the above described arrangement fuel is blown to a position adjacent to the central portion of a space immediately above the porous perforated distributor to form the local hot region in the central portion immediately above the distributor so that the granulating furnace has both the effect of a spouted bed and that of a fluidized bed. Further, the pre-heated raw material powder for cement is blown through the side wall of the cone portion so that the downward moving bed is formed around the local hot region. Since the raw material powder is sufficiently dispersed by the moving bed before it reaches the local hot region, the throat diameter can be enlarged with the granulating characteristics maintained. Therefore, the height of the cone portion can be maintained at a predetermined level even if the apparatus scale is enlarged.

(b) A spouted bed granulating furnace must have a high free board when the furnace scale is enlarged. The jet fluidized bed granulating furnace may comprise a free board having a predetermined height. Therefore, the facility cost can be significantly reduced, and therefore a great economical effect can be obtained.

(c) As described above, the apparatus according to the second aspect of the present invention facilitates the control of the grains so that the product quality is stabilized. Further, the system scale can easily be enlarged, and therefore, the facility cost can be reduced and the heat consumption and electric power consumption can be decreased.

Third Aspect of the Present Invention

An embodiment of an apparatus according to a third aspect of the present invention will now be described with reference to the drawings.

Figure 9:
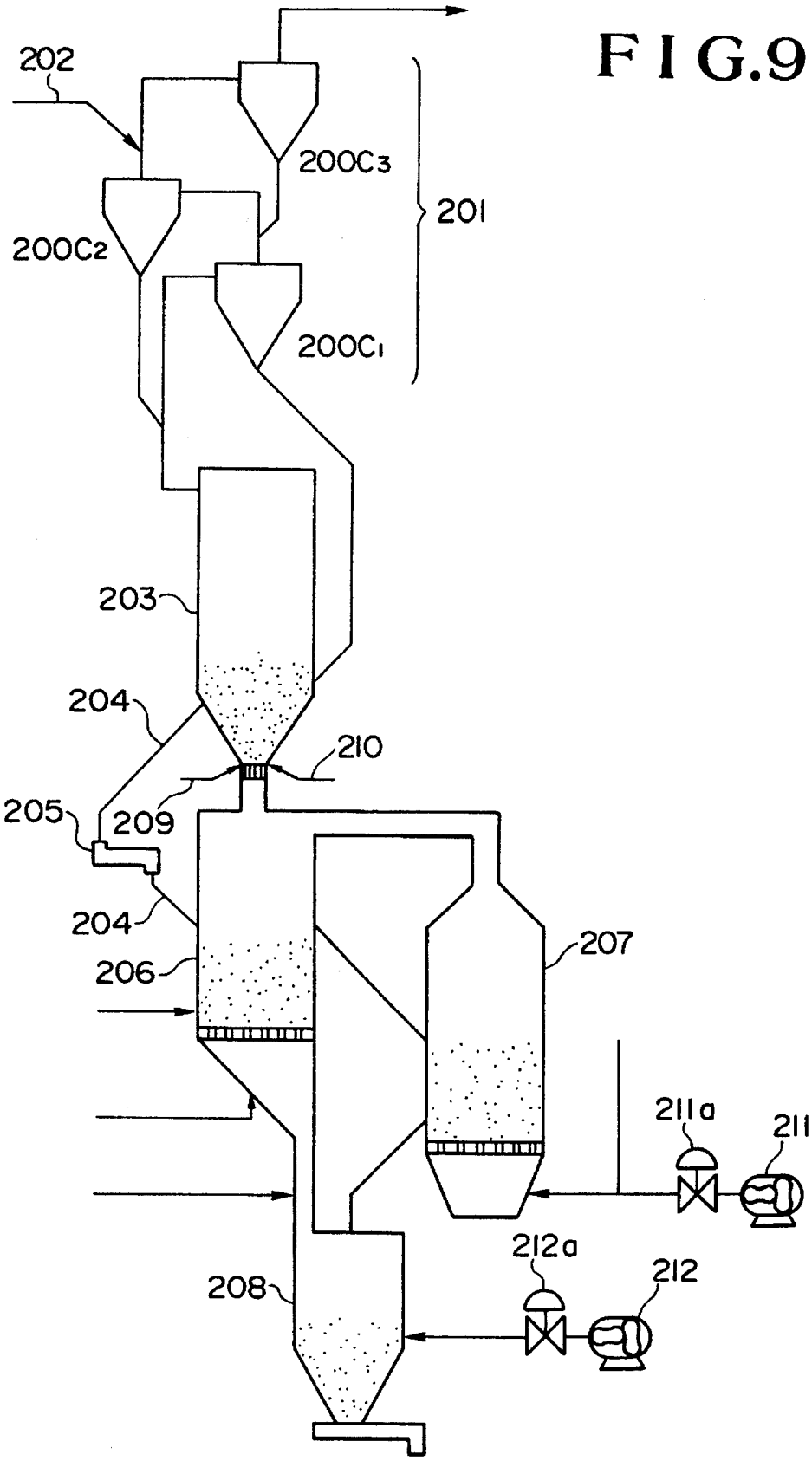
FIG. 9 is a schematic view which illustrates a fluidized bed cement sintering equipment.
Figure 10:
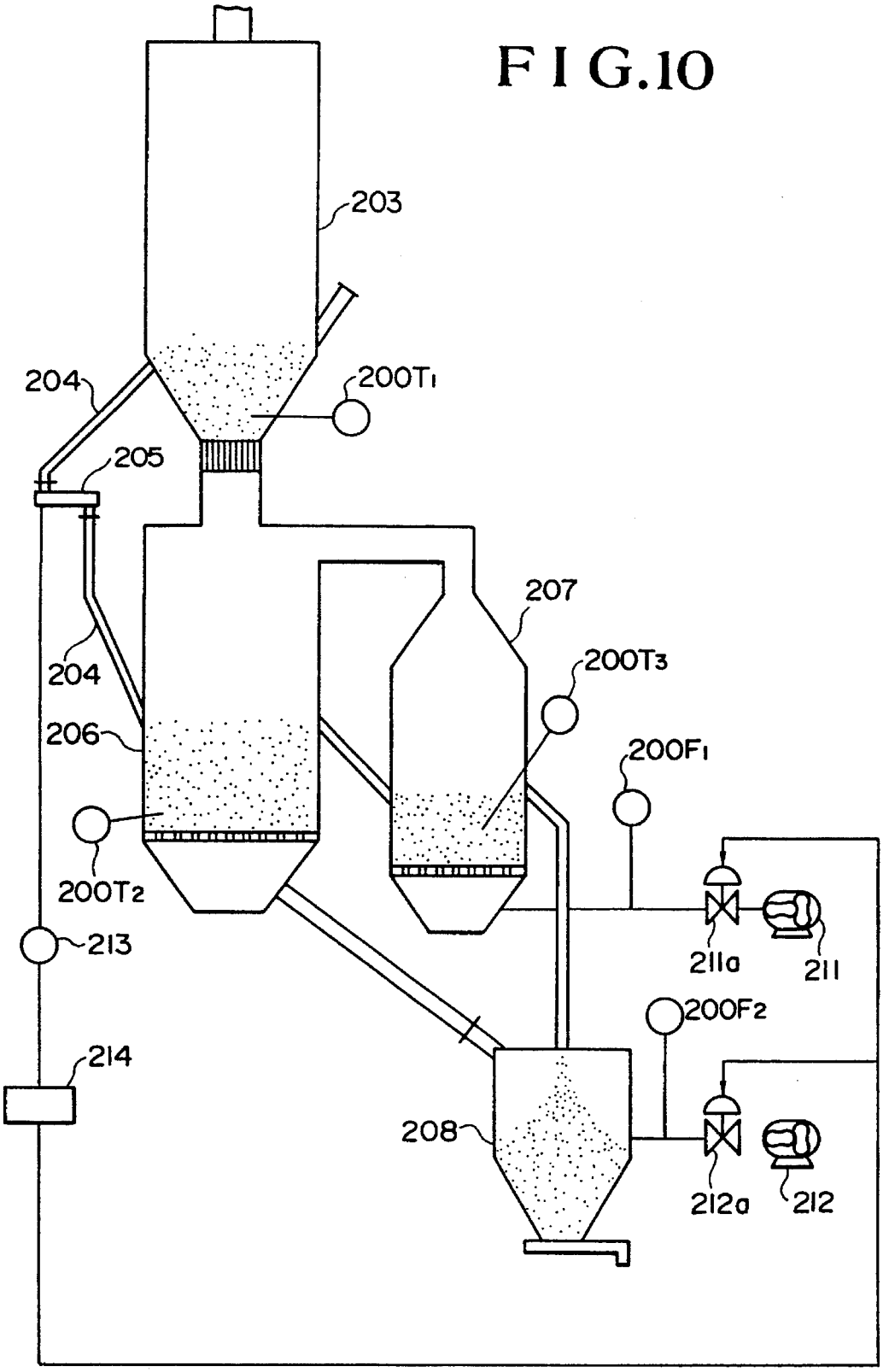
FIG. 10 is a schematic view which illustrates an essential portion of an apparatus for embodying a third aspect of the present invention.
Figure 11:
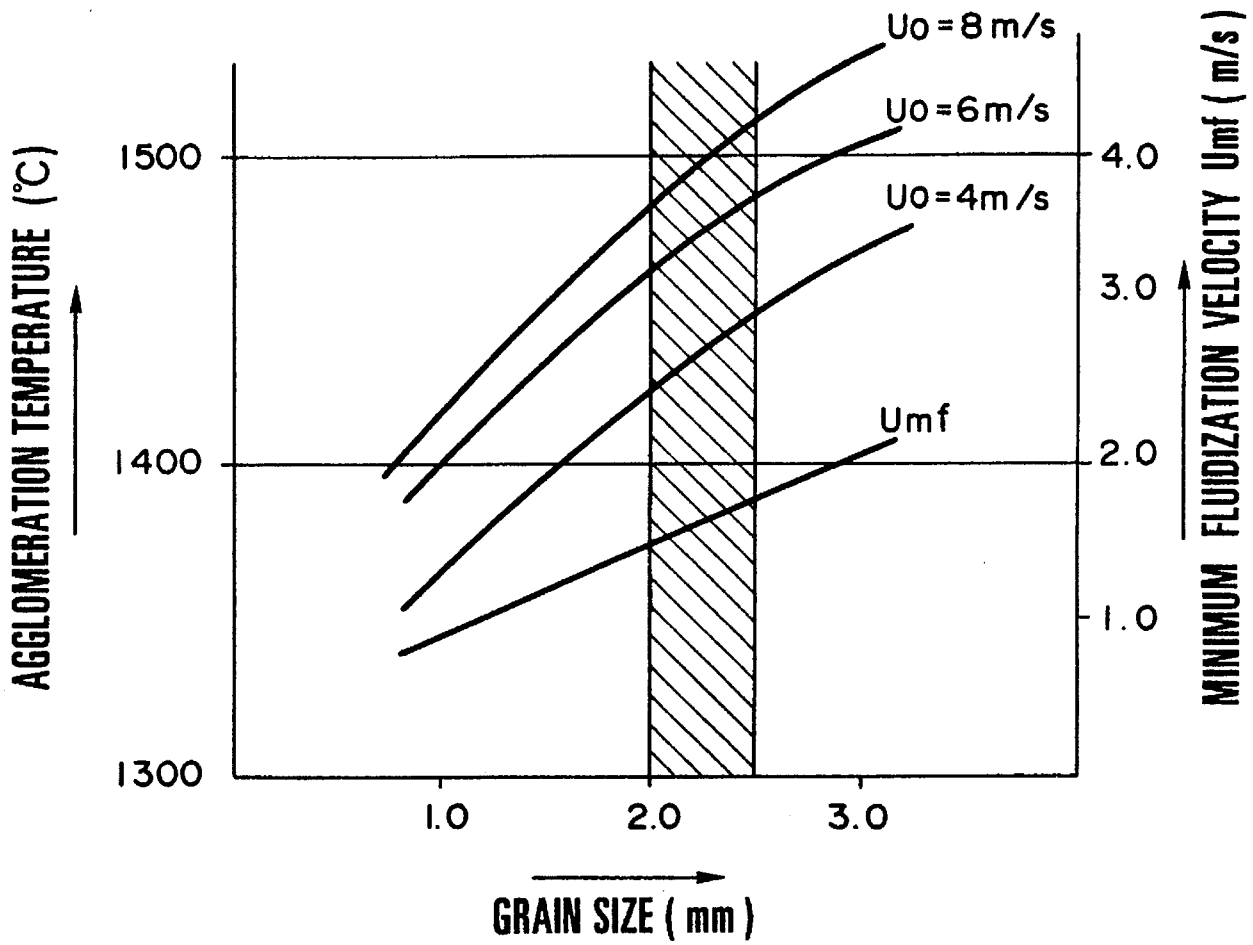
FIG. 11 is a characteristic graph which illustrates the relationship between temperatures of a sintering furnace and grain sizes to indicate the agglomeration temperature in the sintering furnace.

FIG. 9 is a schematic view which illustrates a fluidized bed equipment for sintering cement, FIG. 10 is a schematic view which illustrates an essential portion of an apparatus for embodying the third aspect. FIG. 11 is a characteristic graph which shows the relationship between the temperatures of a sintering furnace and the grain sizes to illustrate agglomeration temperature in the sintering furnace.

Referring to FIG. 9, the general overall system of the apparatus will now be described. Reference numeral 201 represents a suspension pre-heater. The suspension pre-heater 201 comprises cyclones 200$C_1$, 200$C_2$ and 200$C_3$. Raw material powder for cement charged into the system through a raw material injection chute 202 is passed through the cyclones 200$C_1$, 200$C_2$ and 200$C_3$ while being pre-heated, and then it is charged into a jet fluidized bed type granulating furnace 203. Granulated material fluidized and size-refined in the granulating furnace 203 is discharged through a discharge port, and then it is passed through a discharge chute 204 and an L-valve (a hermetic discharge unit) 205 and charged into a fluidized bed sintering furnace 206. It is sintered in the sintering furnace 206, and then the sintered material is passed through a fluidized bed cooler 207 and a packed bed cooler 208 and recovered as cement clinker. Referring to FIG. 9, reference numeral 209 represents a pulverized coal supply line, and 210 represents a heavy oil burner.

The third aspect of the sintering equipment enables the sintering furnace to be continuously stably operated in such a manner that no agglomeration is generated and defective fluidization can be prevented. The structure and the method of operating the apparatus will now be described.

As shown in FIG. 10, the fluidized bed cooler 207 serving as a primary cooling means and the packed bed cooler (multi-chamber fluidized bed cooler or the like) 208 are respectively provided with exclusive Roots blowers 211 and 212 so that cooling air is forcibly supplied to each of the coolers 207 and 208. The L-valve 205 and control valves 211*a* and 212*a* disposed in the air supply pipe line of the Roots blowers 211 and 212 are connected to each other by a control circuit comprising a grain size measuring unit 213 for measuring the grain size of granulated material and a calculating unit 214 for comparing and calculating a signal denoting the result of the measurement, a signal denoting the quantity of the raw material and a signal denoting the quantity of the fuel. Referring to FIG. 10, reference numerals 200F1 and 200F2 represent meters for indicating the quantity of forcibly supplied air, and 200T1, 200T2 and 200T3 represent thermometers for indicating the temperatures of respective fluidized bed.

Operation Method

Granulated material discharged from the granulating furnace is automatically or manually sampled to measure the grain size, and a signal denoting the result of the measurement is supplied to the calculating unit 214.

Assuming that a desired grain size of the granulated material is set to, for example, 2.5±0.5 mm, she following process is performed if the grain size of the sampled granulated material is, for example, 2.0 mm.

(a) The measured grain size of the granulated material and the bed temperature 200T2 of the Roots blower 212 and the sintering furnace 206 are used to calculate the space velocity, $U_0$, of the sintering furnace 206 with which the agglomeration temperature of the sintering furnace 206 is calculated.

(b) If the obtained agglomeration temperature is lower than the sintering temperature+α, the air quantity of the Roots blower 212 is increased.

(c) In accordance with the increase in the air quantity, the fuel to be supplied to the sintering furnace 206 is increased to make the sintering temperature a constant level.

(d) The space velocity, $U_0$, and minimum fluidization velocity, Umf, of, the fluidized bed cooler 207 are calculated. If $U_0$>K×Umf and as well as if the temperature of the fluidized bed cooler 207 is 1100° C. or lower, the air quantity from the Roots blower 211 is decreased.

(e) The quantity of fuel to be supplied to the granulating furnace 203 is adjusted so that the temperature of the granulating furnace 203 is made constant.

If the grain size of the granulated material is 3.0 mm or larger, (a) The space velocity $U_0$ and Umf of the sintering furnace 206 are calculated. If $U_0$<K×Umf, the air quantity from the Roots blower 212 is increased.

(b) In order to make the temperature of the sintering furnace 206 constant, the fuel supply to the sintering furnace 206 is increased in accordance with the increase in the air quantity.

(c) The space velocity $U_0$ and minimum fluidization velocity, Umf, of the fluidized bed cooler 207 are calculated. If $U_0$<K×Umf and the temperature of the fluidized bed cooler 207 is 1100° C. or higher, the quantity of air to be forcibly supplied by the Roots blower 211 is increased. If $U_0$>K× Umf, the quantity of air to be forcibly supplied by the Roots blower 211 is decreased.

(d) The quantity of fuel to be supplied to the granulating furnace 203 is adjusted so that the temperature of the granulating furnace 203 is made constant.

If an abnormality of the grain size of the granulated material is continued, the temperature of the granulating furnace 203 and the quantity of the raw material to be charged are changed to perform grain size recovery. That is, if the grain size is 2 mm or smaller, the temperature of the granulating furnace is raised or the quantity of the raw material to be charged is decreased. If the grain size is 3 mm or larger, the temperature of the granulating furnace is lowered or the quantity of the raw material to be charged is increased. After the grain size has been made normal, the air quantities to be forcibly supplied by the Roots blowers 211 and 212 are restored.

Effect of the Third Aspect

As described above, the structure of the third aspect of the present invention enables the following effects to be obtained.

If the grain size of the material granulated in the granulating furnace encounters a problem due to a disturbance, the air quantities to be forcibly supplied by the primary and secondary cooling means are controlled. As a result, continuous operation is performed while preventing stoppage of the operation of the sintering furnace. Thus, the grain size can be made normal and the operation can continuously and stably be performed.

Fourth Aspect of the Present Invention

A fourth aspect of the present invention will now be described with reference to the drawings.

Figure 12:
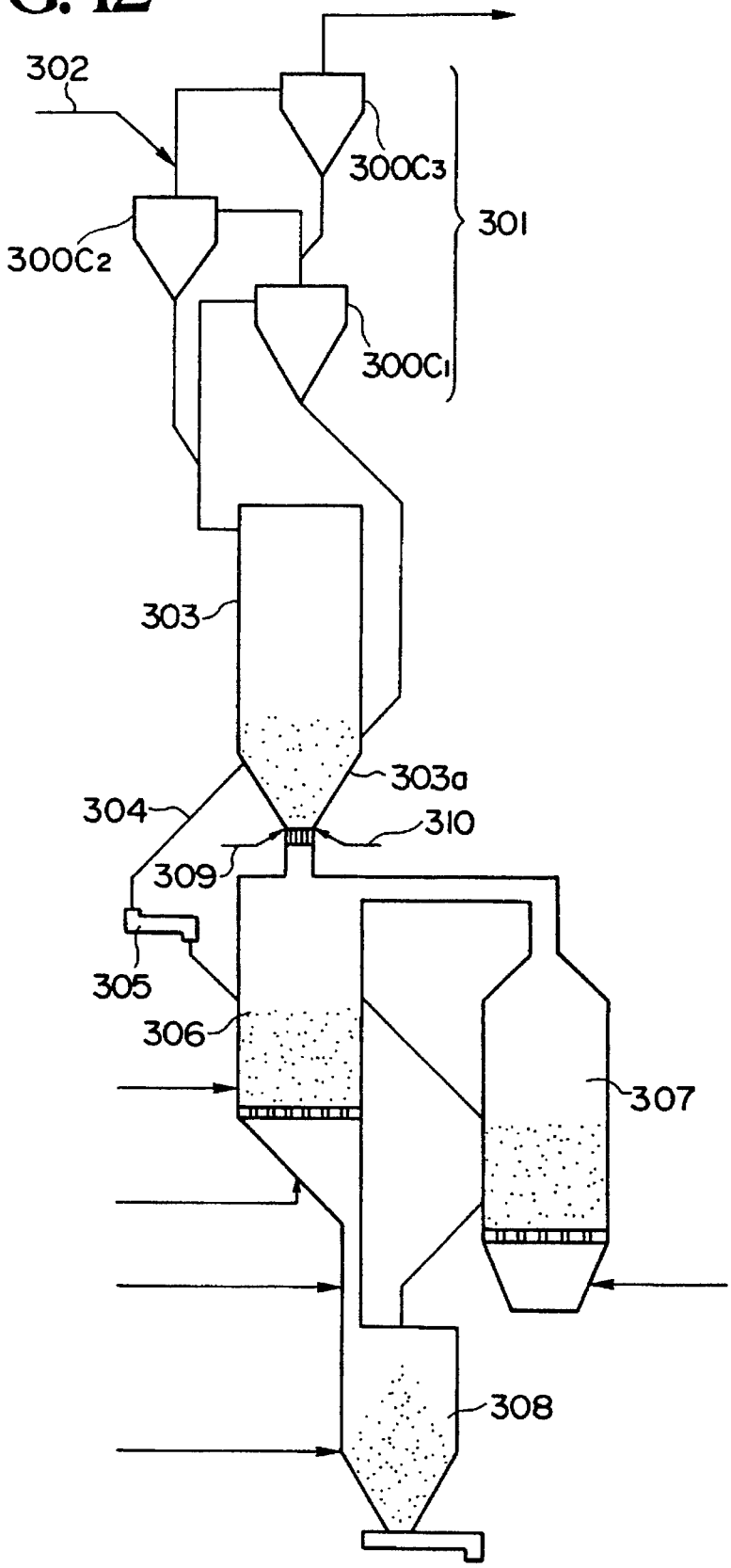
FIG. 12 is a schematic view which illustrates a fluidized bed cement sintering equipment using a granulating furnace according to a fourth aspect of the present invention.
Figure 13:
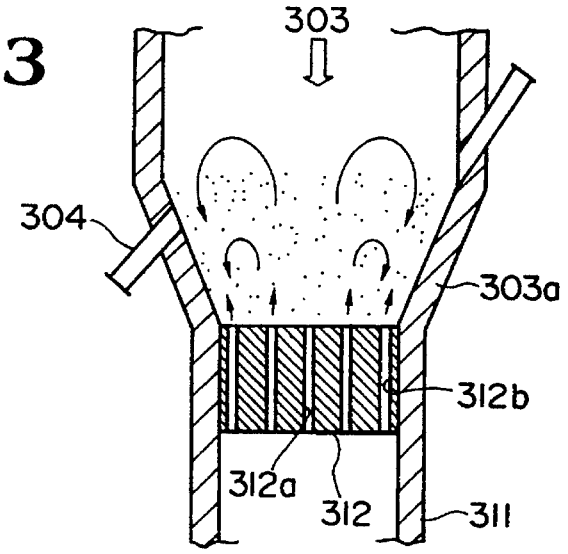
FIG. 13 is a vertical front elevational view which illustrates the granulating furnace of FIG. 12.
Figure 14:
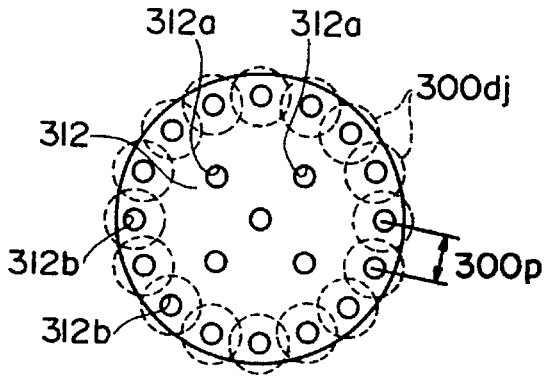
FIG. 14 is a plan view which illustrates a distributor.
Figure 15:
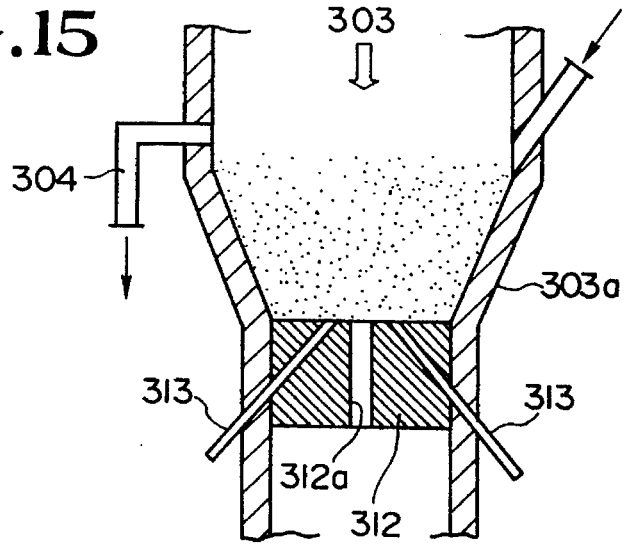
FIG. 15 is a vertical front elevational view which illustrates a granulating furnace having a fuel blowing nozzle disposed adjacent to the central portion of the distributor.
Figure 16:
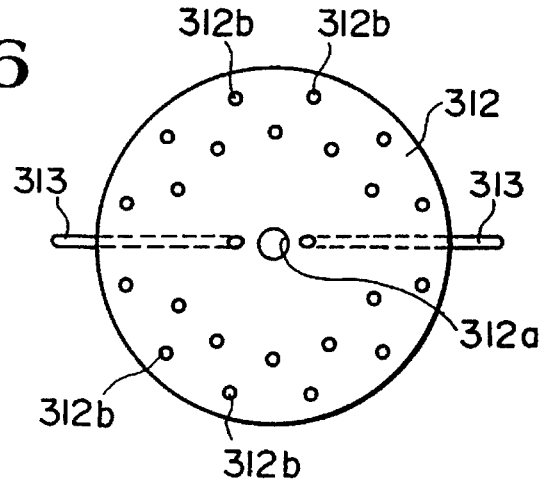
FIG. 16 is a plan view which illustrates a first embodiment of the distributor shown in FIG. 15.
Figure 17:
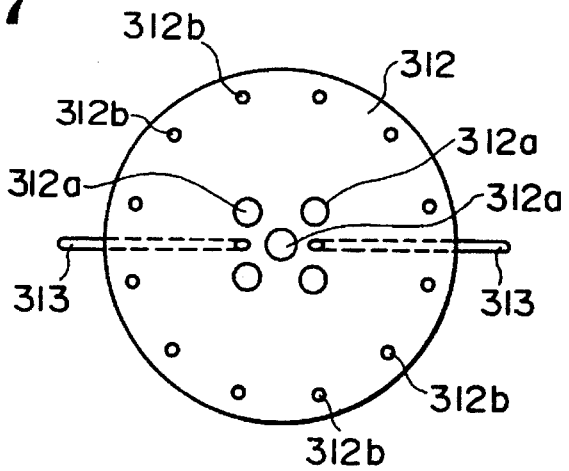
FIG. 17 is a plan view which illustrates a second embodiment of the distributor shown in FIG. 15.
Figure 18:
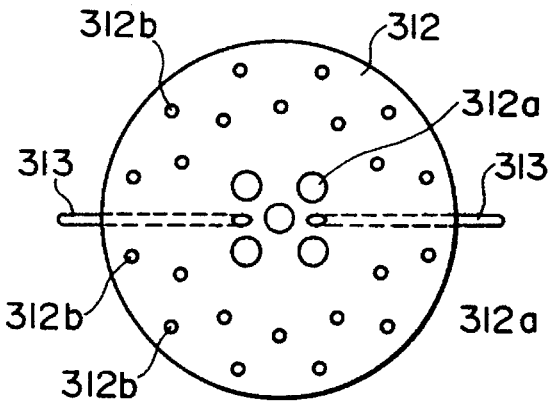
FIG. 18 is a plan view which illustrates a third embodiment of the distributor shown in FIG. 15.

FIG. 12 is a schematic view which illustrates a fluidized bed equipment for sintering cement using a granulating furnace according to the fourth aspect of the present invention. FIG. 13 is a front elevational vertical cross sectional view which illustrates the granulating furnace, and FIG. 14 is a plan view which illustrates a distributor. FIG. 15 is a front elevational vertical cross sectional view which illustrates a granulating furnace having a fuel blowing nozzle disposed adjacent to the central portion of the distributor. FIG. 16 is a plan view which illustrates a first embodiment of the distributor shown in FIG. 15, FIG. 17 is a plan view which illustrates a second embodiment of the distributor shown in FIG. 15, and FIG. 18 is a plan view which illustrates a third embodiment of the distributor shown in FIG. 15.

Referring to FIG. 12, the overall system of the apparatus will now be described. Reference numeral 301 represents a suspension pre-heater. The suspension pre-heater 301 comprises cyclones 300C1, 300C2 and 300C3. Raw material powder for cement charged into the system through a raw material injection chute 302 is passed through the cyclones 300C1, 300C2 and 300C3 while being pre-heated, and then it is charged into a jet fluidized bed type granulating furnace 303. Granulated material fluidized and size-refined in the granulating furnace 303 is discharged through an overflow discharge port, and then it is passed through a discharge chute 304 and an L-valve (a hermetic discharge unit) 305 and charged into a fluidized bed sintering furnace 306. It is sintered in the sintering furnace 306, and then the sintered material is passed through a fluidized bed cooler 307 and a packed bed cooler 308 and recovered as cement clinker. Referring to FIG. 12, reference numeral 309 represents a pulverized coal supply line, and 310 represents a heavy oil burner.

Referring to FIGS. 13 and 14, the fluidized bed type granulating furnace 303 will now be described. A perforated plate distributor 312 is disposed above a throat portion 311 formed in the granulating furnace 303, the perforated plate distributor 312 having an upper surface which is disposed adjacent to the lower end of a cone portion **303*a* of the granulating furnace 303. Further, a plurality of large-diameter nozzles 312*a* are formed at the central portion of the distributor 312, while a multiplicity of small-diameter nozzles 312*b* are formed on the periphery portion of the same. The jet stream diameter 300*dj* of the outermost small-diameter nozzle 312*b* is made to be larger than the nozzle pitch 300*p***.

The discharge of large-diameter granulated materials to the fluidized bed sintering furnace 306 can be smoothly performed in inverse proportion to the number of the nozzles disposed at the central portion of the distributor 312 and in proportion to the diameter of the same. In this case, abnormal fluidization can be prevented and stable operation can be performed for a long time while improving the strength of the distributor 312.

The jet fluidized bed granulating furnace 303 will now be described with reference to FIGS. 15 to 18. FIGS. 15 and 16 illustrate a structure arranged in such a manner that one large-diameter nozzle 312*a* is formed at the central portion of the distributor 312 and the small-diameter nozzles 312*b* are equally dispersed. Further, a fuel blowing nozzle (a burner) 313 is disposed adjacent to the large-diameter nozzle 312*a*. An embodiment shown in FIG. 17 is arranged in such a manner that a plurality of large-diameter nozzles 312*a* are formed at the central portion of the distributor 312 and the small-diameter nozzles 312*b* are formed on the periphery at an adequate pitch. Further, the fuel blowing nozzle (the burner) 313 is disposed adjacent to the large-diameter nozzle 312*a* disposed at the central portion of the distributor 312. An embodiment shown in FIG. 18 is arranged in such a manner that a plurality of the large-diameter nozzles 312*a* are formed at the central portion of the distributor 312 and the small-diameter nozzles 312*b* are equally distributed. Further, the fuel blowing nozzle (the burner) 313 is disposed adjacent to the large-diameter nozzle 312*a* disposed at the central portion of the distributor 312.

Operation

The structure, in which the large-diameter nozzle 312*a* is disposed at the central portion of the distributor 312 of the granulating furnace 303 and the small-diameter nozzles 312*b* are disposed at the periphery of the same, results in the following movement of grains in the fluidized bed.

(a) The quantity of the fluidizing gas supplied through the large-diameter nozzle 312*a* is larger than the quantity of the fluidizing gas supplied through the peripheral small-diameter nozzles 312*b*. As a result, the grain raising energy at the central portion of the granulating furnace 303 is larger than that in the periphery portion of the granulating furnace 303. Therefore, an interlayer particle circulating flow is formed in which grains at the central portion form ascending flows using the fluidized gas supplied through the large-diameter nozzle 312*a* and peripheral grains form descending flows.

(b) If the fuel blowing nozzle is disposed adjacent to the large-diameter nozzle 312*a*, a temperature distribution is realized in the fluidized bed in which the temperature of the central portion in the fluidized bed is high and that of the periphery is low. As a result, the granulating space is limited to the central portion of the furnace, and therefore coating on the wall surface can be prevented.

(c) The large-diameter nozzle 312*a* disposed at the central portion of the distributor 312 discharges large-diameter granulated material generated in the granulating furnace 303 so that abnormal fluidization in the granulating furnace 303 is prevented.

Effect of the Fourth Aspect

The structure of the fourth aspect of the present invention enables the following effects to be obtained.

(a) Since the jet diameter of the outermost nozzle disposed at the periphery of the distributor is made larger than the nozzle pitch, dead zones can be eliminated from the periphery of the distributor. Therefore, generation of coating and adhesion in the cone portion of the granulating furnace can be rationally prevented.

(b) Since the large-diameter nozzle is disposed at the central portion of the distributor and the small diameter nozzles are disposed in the periphery of the same, an interlayer grain circulating flow is formed in which grains in the fluidized bed form ascending flows using the fluidized gas supplied through the large-diameter nozzle and grains in the periphery form descending flows. Therefore, generation of coating and adhesion in the cone portion of the granulating furnace can be prevented (c) Since the large-diameter nozzle is disposed, granulated material generated in the granulating furnace and having a large diameter is discharged to the sintering furnace by way of the large-diameter nozzle. Therefore, abnormal fluidization in the granulating furnace can be rationally prevented. Therefore, operation can be stably performed for a long time.

(d) Since the fuel blowing, nozzle is disposed adjacent to the large-diameter nozzle disposed at the central portion of the distributor, the temperature distribution in which the temperature at the central portion of the bed is high and that at the periphery is low can be formed in the bed. As a result, the granulation space is limited to the central portion of the furnace, and therefore coating to the cone portion in the layer can be prevented.

Fifth Aspect of the Present Invention

A fifth aspect of the present invention will now be described with reference to the drawings.

Figure 19:
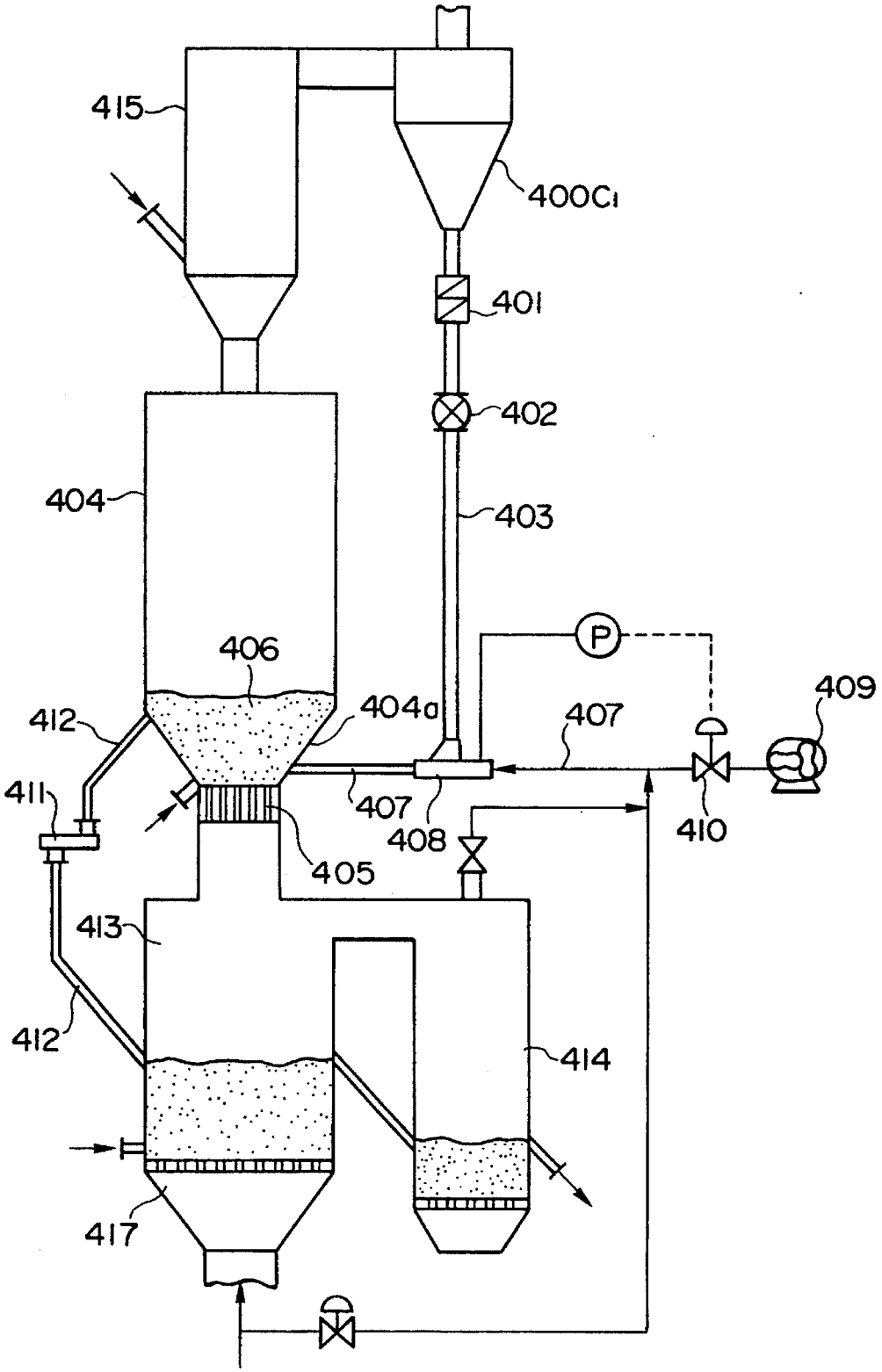
FIG. 19 is a schematic view which illustrates an apparatus according to a fifth aspect of the present invention.
Figure 20:
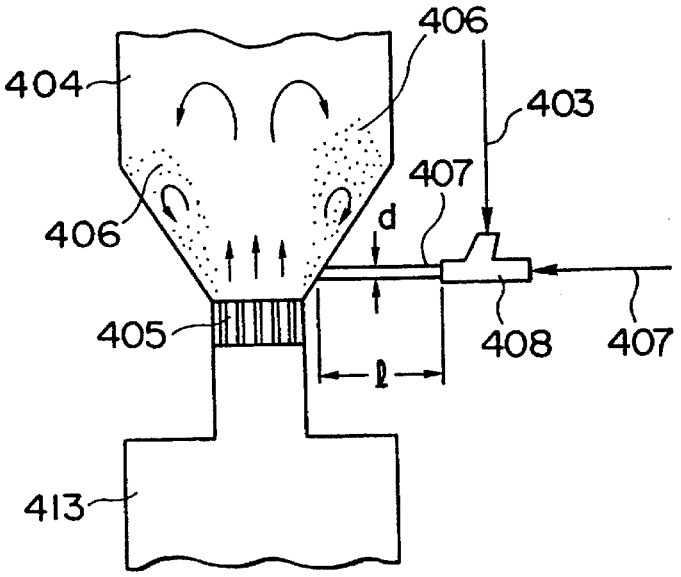
FIG. 20 is a vertical front elevational view which illustrates an essential portion of a fluidized state realized in a granulating furnace.
Figure 21:
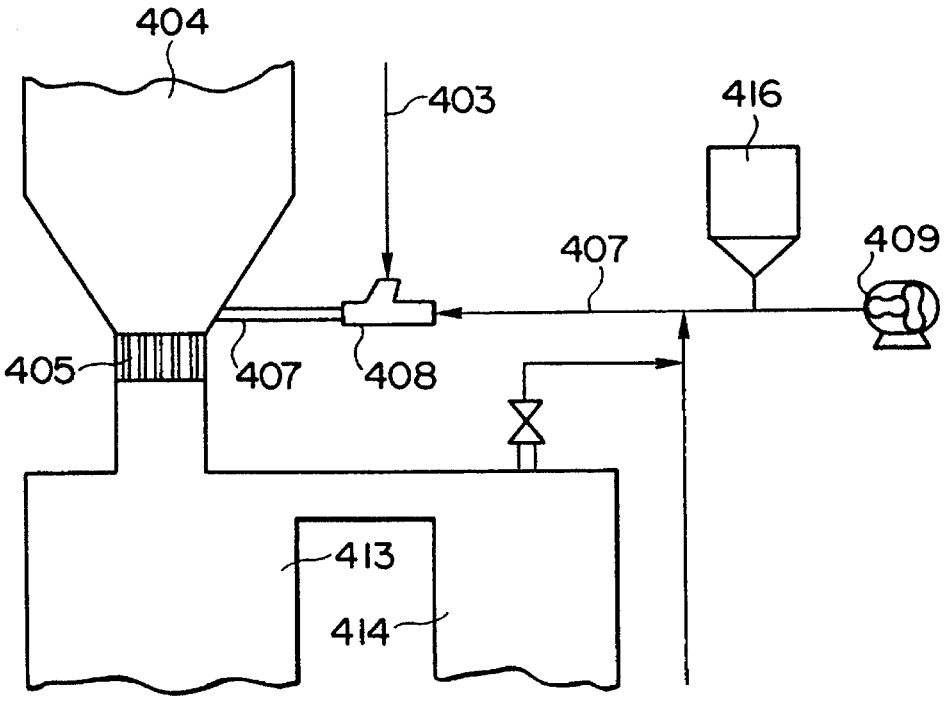
FIG. 21 is a schematic view which illustrates an embodiment in which a fuel supply means is connected to a pressurized air supply pipe.

FIG. 19 is a schematic view which illustrates an apparatus according to this aspect. FIG. 20 is a front elevational vertical cross sectional view which illustrates an essential portion to show a state of a fluidized bed in a granulating furnace. FIG. 21 is a schematic view which illustrates an embodiment in which a raw material supply means is connected to a pressurized air supply pipe.

Referring to FIGS. 19 and 20, a first embodiment of this aspect will now be described. An double opening/closing damper 401 serving as a hermetic discharge unit and a pre-heated raw material supply chute 403 having a rotary valve 402 and the like are connected to a lower position of a lowermost cyclone 400C1 forming a suspension preheater. A pressurized-air supply pipe 407 is connected to a cone portion 404*a* disposed below an interfacial surface of a fluidized bed 406, the connection being performed on a distributor 405 of a jet fluidized bed granulating furnace 404 for receiving pre-heated raw material to granulate it. An ejector 408 is interposed at a predetermined position of the pressurized-air supply pipe 407, the ejector 408 receiving the lower end of the foregoing supply chute 403 connected thereto. An exclusive Roots blower 409 is connected to an end of the pressurized-air supply pipe 407. Further, a flow-quantity control valve 410 is disposed in a pipe portion arranged between the ejector 408 disposed in the pressurized-air supply pipe 407 and the Roots blower 409. As a result, a pressure meter P detects the pressure in the pipe. In accordance with a signal denoting the detected pressure, the foregoing valve 410 is controlled.

Material granulated in the granulating furnace 404 is discharged and supplied to a fluidized bed sintering furnace 413 through a discharge chute 412 having an L valve 411 formed into a hermetic discharge structure. Cement clinker sintered in the sintering furnace 413 is cooled by a fluidized bed cooler 414. Hot discharge gas supplied from a free board of the fluidized bed cooler 414 may be supplied to the pressurized-air supply pipe 407 in place of pressurized air supplied through the Roots blower 409. A portion of air to be supplied to a wind box 412 of the fluidized bed sintering furnace 413 may be branched as to be supplied to the pressurized-air supply pipe 407. Referring to the drawing, reference numeral 415 represents a pre-calciner. Small grains and raw material heated by the pre-calciner 415 are captured by the cyclone 400C1 as to be supplied, allowed to adhere and granulated in the granulating furnace 404 by way of the supply chute 403.

It is preferable that the length l of the pressurized-air supply pipe 407 arranged between the ejector 408 and the granulating furnace 404 and the pipe diameter d hold the relationship expressed by l/d>10 as shown in FIG. 20 in order to accelerate the raw material. The ratio of the weight of the raw material and that of the pressurized air, that is, the solid-gas ratio is made to be 5 to 15 kg raw/kg air and the flow velocity is made to be 20 m/sec or higher.

An embodiment shown in FIG. 21 is arranged in such a manner that a pulverized coal silo 416 is connected to the pressurized-air supply pipe 407 arranged between the ejector 408 and an exclusive Roots blower 409 so that raw material for cement and the pulverized coal are mixed and blown into the granulating furnace 404.

Pre-heated raw material captured by the cyclone 400C1 is charged into the ejector 408 in such a manner that back flows from the ejector 408 are prevented by the double opening/closing damper 401 and a rotary valve 402. The quantity of pressurized air to be blown from the Roots blower 409 into the granulating furnace 404 is controlled in such a manner that the flow velocity of the blown air is 20 m/sec or higher. The position through which the pressurized air is blown is adequately determined at an intermediate position between the upper surface of the distributor 405 and the interfacial surface to be capable of passing through the downward moving bed formed at the cone portion of the granulating furnace. The direction in which the pressurized air is blown may be inclined by ±30° with respect to the horizontal line.

Although the temperature of the raw material captured by the cyclone 400C1 is 700° C. to 800° C. and this level is then lowered by about 50° C. by the pressurized air, no heat loss takes place because it is recovered and used again as hot air. If hot air is branched from the upper portions of the sintering furnace 413 and the fluidized bed cooler 414 and that from the forcibly blown air in the sintering furnace 413 is used as pressurized air, the temperature of the raw material captured by the cyclone 400C1 can be heated. Therefore, the granulating performance of the granulating furnace 404 can be improved.

Effect of the Fifth Aspect

As described above, the structure of the fifth aspect of the present invention enables the following effects to be obtained.

(a) Pre-heated raw material uniformly dispersed in pressurized air can be blown as to penetrate the downward moving bed of the granulating furnace. Therefore, the raw material can effectively be distributed in the fluidized bed to perform the granulation uniformly. Further, no coating is generated adjacent to the raw material blowing port as is suffered with the conventional technology. Therefore, the operation of the apparatus can continuously stably be performed.

(b) Since the raw material can satisfactorily be dispersed in the fluidized bed, the granulating performance can be improved such that the temperature needed to perform the granulation, the heat consumption can be reduced and the manufacturing yield can be improved, resulting in significant effects.

(c) Undesirable discharge to the free board can be reduced, the heat consumption can be reduced because the quantity of circulation made between the granulating furnace and the cyclone 400C1 can be decreased. Further, the coating occurring in the upper portion of the granulating furnace is prevented, and therefore the operation efficiency can be improved.

Sixth Aspect of the Present Invention

Figure 22A:
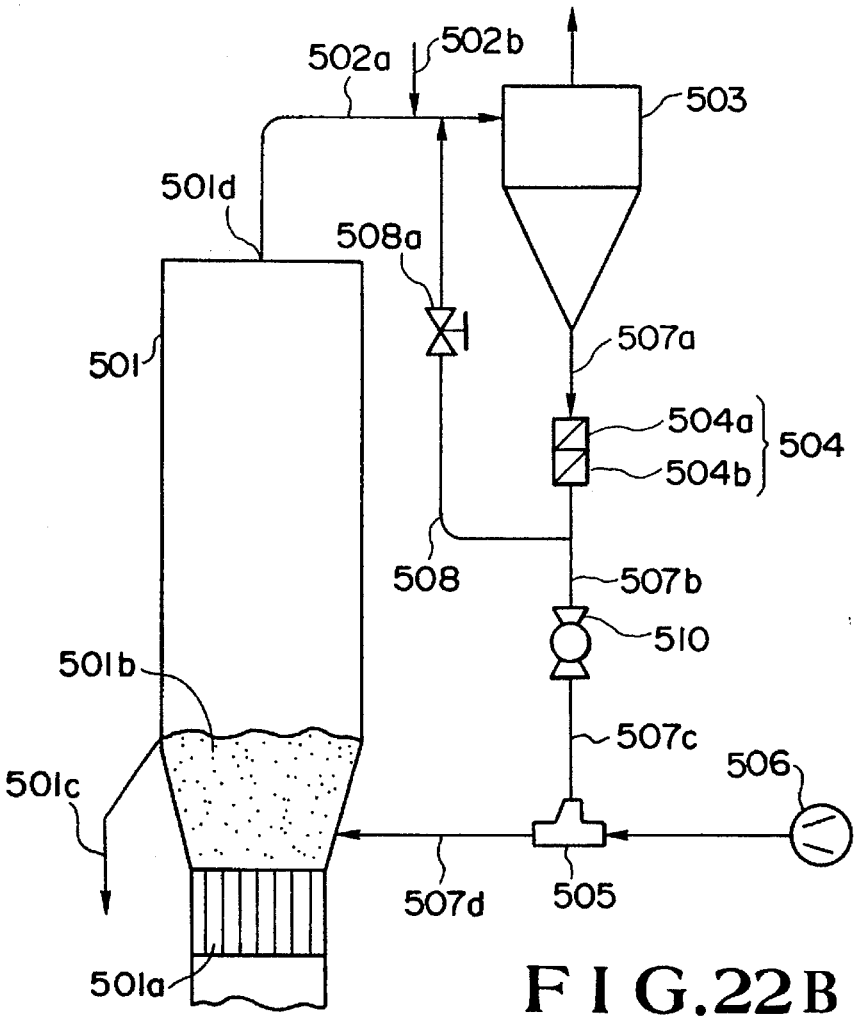
Figure 22B:
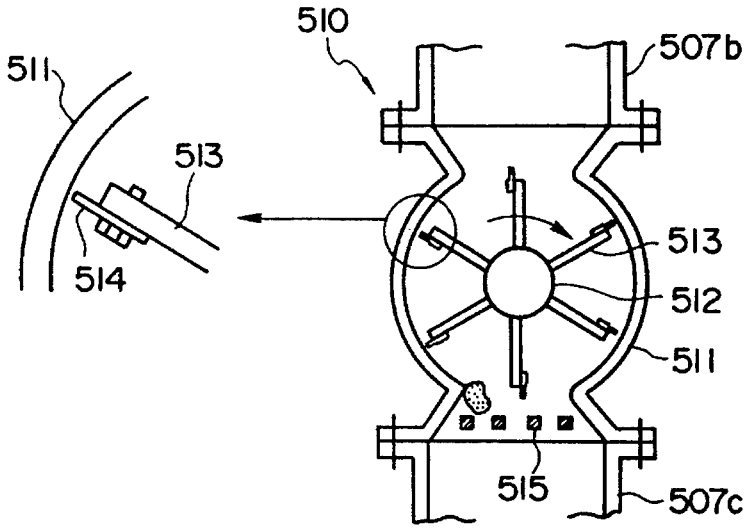

FIGS. 22A and 22B illustrate a first embodiment of a sixth aspect of the present invention. Referring to FIGS. 22A and 22B, reference numeral 501 represents a fluidized bed furnace which is included in, for example, a furnace of cement sintering equipment and which granulates raw material powder in a hot atmosphere. The furnace 501 includes a distributor (a porous perforated plate) 501*l* as to receive raw material powder supplied thereto. Further, hot gas supplied from a position below the distributor 501*a* forms a fluidized bed 501*a* on the distributor 501*a* so that the efficiency of heating and granulating the raw material is improved. Granulated grains are received through an overflow chute 501*c* connected to the side surface of the furnace 501, while hot gas is, by way of a fluid passage 502*a*, introduced into a cyclone 503 through a discharge port 501*d* disposed in the upper portion of the furnace 501. Although small raw material powder floats in the gas and raw material powder is charged into the fluid passage 502*a* through a chute 502*b*, they are separated from gas (discharged upwards) in the cyclone 503 while being pre-heated by the gas so that they are dropped into a supply chute 507*a* disposed in the lower portion of the cyclone 503. The raw material powder, which has reached the inside of the supply chute 507*a*, is passed through a double opening/closing damper 504 and the like (to be described later) disposed below the supply chute 507*a*, and it is charged into the furnace 501 through a supply chute 507*d*. Since the supply chute 507*d* is positioned adjacent to the relatively high pressure furnace 501 and having higher pressure than that in the supply chute 507*a*, this embodiment comprises the following raw material injection unit disposed between the foregoing supply chutes 507*a* and 507*d*.

The raw material injection apparatus is formed by disposing the double opening/closing damper 504, a rotary damper 510 and an ejector 505 in the foregoing sequential order while being connected by raw material powder supply chutes 507*b* and 507*c*. Further, a pipe 508 and the like are connected as illustrated. The double opening/closing damper 504 is formed by two electric-butterfly dampers 504*a* and 504*b* connected vertically. In a procedure arranged such that the upper damper 504*a* is opened in a state where the lower damper 504*b* is closed, and then the upper damper 504*a* is closed to open the lower damper 504*b*, the double opening/closing damper 504 intermittently shakes off the raw material powder while preventing upward blowing (the back flow) of the gas from a portion adjacent to the high pressure supply chute 507*d*. The ejector 505 is a blowing means constituted in such a manner that it conveys the raw material powder dropped (adjacently) in the inside horizontal portion into the supply chute 507*d* with compressed air supplied through the blower 506 and as well as blows the same into the fluidized bed furnace 501.

The rotary damper 510 is a known grain discharging means arranged in such a manner that an impeller 513 is rotated in a predetermined direction together with a shaft 512 in a casing 511 including a horizontal cylindrical portion. Since raw material powder is accumulated on the upper surface of the impeller 513 and the inner surface of the upper portion of the casing 511, the rotary damper has a characteristic such that the vertical gap is reduced to have a sealing characteristic, with which the air communication between the upstream (the upper portion of the drawing) and the downstream (the lower portion of the drawing) is interrupted. This embodiment employs a novel structural means to further improve the sealing characteristic and the function of crushing coarse grains. A first means is a structure arranged in such a manner that a thin plate 514 is fastened to each end of the blades of the impeller 513 such that their positions can be adjusted. As a result, the gap from the internal surface of the casing 511 can be minimized regardless of wear of each portion, and therefore the sealing performance can be improved. A second means is a structure arranged in such a manner that a slatted grizzly member 515 is disposed in a lower portion in the casing 511. As a result, grains are so crumpled between the grizzly member 511 and the impeller 513 that a coarse component of the grains can be crushed. Therefore, the rotary damper 510 has a satisfactory sealing characteristic and a function of crushing coarse grains as well as having its original function of continuously discharging the raw material powder retained in the upper portion thereof by the rotation of the impeller 513. The excellent sealing characteristics and the sealing characteristic of the damper 504 enable blowing up (the back flow) of the gas into the cyclone 503 from the supply chute **507*d* to be assuredly prevented. Further, the function of crushing coarse grains enables clogging of the raw material powder in the supply chute 507*d* having a relatively small diameter to raise the speed to be efficiently prevented. The impeller 513 may have metal wires densely disposed like a brush in place of the foregoing thin plates 514**.

The raw material injection unit structured as described above as shown in FIG. 22A usually smoothly injects raw material powder into the fluidized bed furnace 501. Further, the cyclone 503 exhibits an excellent efficiency of capturing raw material powder. The foregoing satisfactory state cannot always be maintained regardless of the condition for use of the foregoing apparatus and the period in which the same is used. For example, the damper 504 cannot completely overcome a problem that raw material powder is held between the valve and a seat with which the valve comes in contact. The rotary damper 510 suffers from an unsatisfactory sealing performance if each portion has worn until it has been overcome by adjusting the positions of the thin plates 514. Accordingly, this embodiment is arranged in such a manner that the supply chute **507*b* directly connected to the inside portion of the casing 511 of the rotary damper 510 and a gas passage 502*a* connected to the cyclone 503 are connected to each other by the pipe 508 including a valve 508*a*. When the valve 508*a* is opened, the foregoing pipe 508 equalizes the pressure in the rotary damper 510 and that in the cyclone 503. Therefore, upward blowing of the gas to the lower portion of the cyclone 503** can be prevented, and accordingly raw material powder can normally be captured.

Figure 23A:
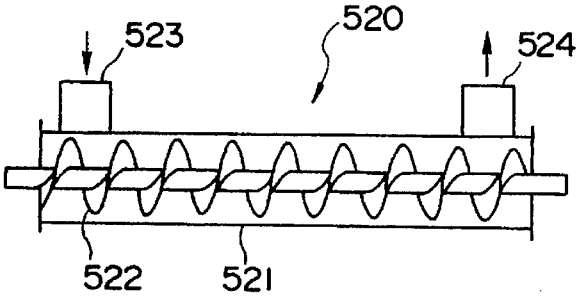
Figure 23B:
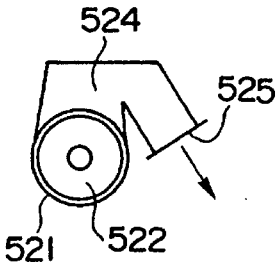

FIGS. 23A and 23B illustrate a second embodiment of the sixth aspect of the present invention. Also this embodiment is arranged in such a manner that the unit for injecting raw material grain into a fluidized bed furnace (omitted from illustration) is formed from a double opening/closing damper (omitted from illustration), a discharge means and a blowing means (omitted from illustration). The discharge means comprises a screw conveyer 520 shown in FIG. 24 in place of the rotary damper 510 shown in FIG. 22A. The screw conveyer 520 comprises a screw 522 disposed to pass through a horizontal cylindrical casing 521. By rotating the screw 522, raw material supplied through an injection port 523 (connected to the supply chute **507*b* shown in FIG. 22A) is conveyed to a raw material discharge port 525 (the supply chute 507*c* shown in FIG. 22) supplied through the injection port 523 (connected to the supply chute 507*b* shown in FIG. 22**A).

Although a screw conveyer is originally able to continuously discharge grains, the screw conveyer 520 according to this embodiment acts to fill at least a place in the casing 521 with grains to use a so-called material sealing function effected by filled grains so that an excellent sealing characteristic is obtained between the upstream and the downstream. That is, an ascending pipe 524 is disposed in front of the discharge port 525 so that ascending pipe 524 is always filled with grains until grains to be discharged flow over the ascending pipe 524. Therefore, the ascending pipe 524 is made higher than the top surface of the cylindrical portion of the casing 521. Since the screw conveyer 520 is able to continuously discharge grains and exhibits excellent sealing performance, the screw conveyer 520 can be used similarly to the rotary damper 510 shown in FIG. 22A. If the bottom portion of the casing 521 and the screw 522 have an adequate gap therebetween to cause the coarse component to be retained and is able to be arbitrarily removed by a number of the operation staff, an advantage is realized because clogging in an ensuing blowing means can satisfactorily be prevented.

Figure 24:
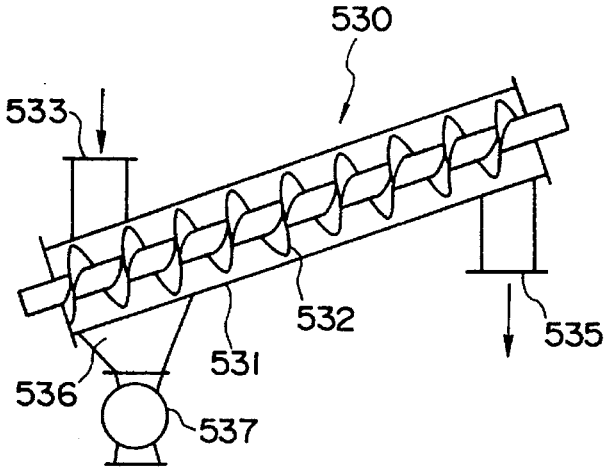
FIG. 24 is a cross sectional view which illustrates an inclined-type screw conveyer for use as a discharge means of a raw material injecting apparatus according to a third embodiment of the sixth aspect of the present invention.

FIG. 24 illustrates a third embodiment of the sixth aspect of the present invention, wherein a screw conveyer 530 is disposed to be inclined to serve as a means (in place of the rotary damper 510 shown in FIG. 22A and the conveyer 520 shown in FIG. 23A) for discharging granular raw material. Although the screw conveyer 530 comprises a casing 531, a screw 532, an injection port 533 and a discharge port 535 similar to that shown in FIG. 23A, it is inclined by about 30° while making its portion having the discharge port 535 formed therein to face upwards in place of disposing the ascending pipe. Since it is inclined such that grains to be discharged ascends from the lowest portion of the casing 531 by a height higher than the inner diameter of the casing 531, at least a low portion of the casing 531 adjacent to the injection port 533 is filled with grains. As a result, a so-called material sealing is realized. In this embodiment, a coarse grain retainer 536 is formed in the lowest portion of the casing 531 and a rotational valve 537 is connected to the lower portion of the coarse grain retainer 536 to facilitate selection of coarse grains and discharge of the same.

Figure 25A:
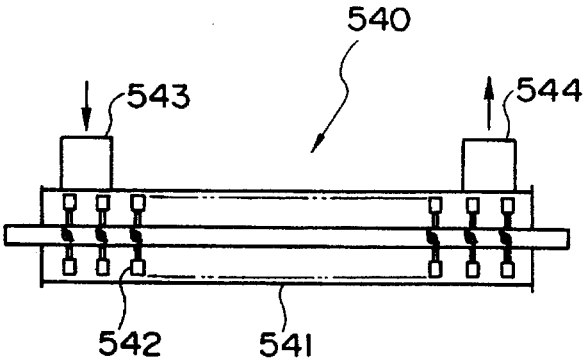
Figure 25B:
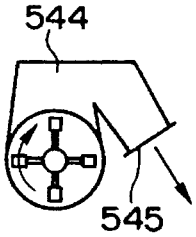

The screw conveyer serving as the discharge means may be a screw conveyer in a wide sense having the screw bodies which are cut. FIGS. 25A and B illustrate an embodiment arranged in such a manner that a puddle screw conveyer 540 is used as the screw conveyer in a broad sense. Although this embodiment comprises the casing 541 having the grain injection port 543, an ascending pipe 544 and a discharge port 545 similar to the conveyer 520 shown in FIG. 23A, the casing 541 includes a discontinuous plate-like paddle 542 which can be rotated. Also the paddle screw conveyer 540 arranged as described above is able to continuously discharge grains. Since the presence of the ascending pipe 544 realizes the material sealing function. Although the efficiency of discharging coarse component because the gap is present between the paddles 542, an advantage can be obtained in that clogging of coarse grains in the ensuing blowing means can satisfactorily be prevented. As an alternative to the paddle screw conveyer, a conveyer using a ribbon screw or a cut flight screw or the like may be used as the discharge means of the raw material injection unit.

Figure 26:
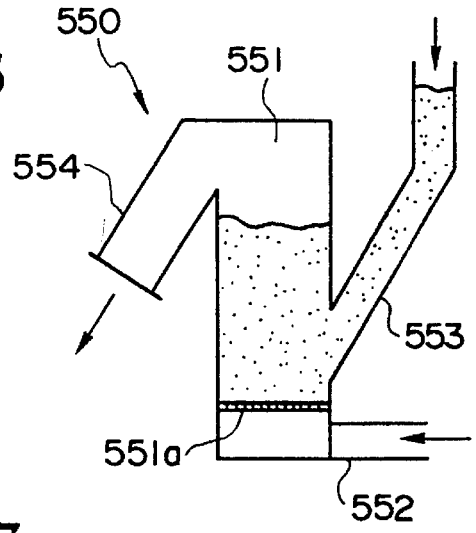
FIG. 26 is a cross sectional view which illustrates a container for use as a discharge means of a raw material injection apparatus according to a fifth embodiment of the sixth aspect of the present invention.

FIG. 26 illustrates a vertical container 550 which is a discharge means arranged in such a manner that grains are accumulated in a portion thereof to realize the material sealing function with which the air communication between the upstream and the downstream can be interrupted. Further, grains are fluidized to be continuously discharged. Referring to FIG. 26, reference numeral 551 represents a fluidizing portion of the discharging means having a distributor 551*a* in the lower portion thereof. Reference numeral 552 represents a pipe for introducing gas to perform the fluidization, 553 represents a raw material supply chute for accumulating grains to supply it to the fluidizing portion 551, and 554 represents a discharge chute for discharging fluidized and overflow grains with the gas. Since coarse grains mixed with the granular raw material is retained on the distributor 551*a*, it is not fluidized and it does not reach the discharge chute 554. Therefore, the problem of clogging of the blowing means can be prevented.

Effect of the Sixth Aspect

The raw material injection unit according to the sixth aspect of the present invention enables the following effects to be obtained.

(1) Since upward blowing (the back flow) from the fluidized bed furnace toward the cyclone can effectively be prevented, the injection of granular raw material into the fluidized bed furnace can smoothly be performed. Further, raw material can efficiently be captured in the cyclone.

(2) Since granular raw material is continuously charged into the fluidized bed furnace, the quantity of the compressed gas consumption needed to perform blowing can be reduced. Further, the risk that the gas component and the temperature condition in the furnace are made inadequately can be overcome.

(3) Even if the original performance of the apparatus cannot be exhibited due to wear or the like or even if the pressure in the furnace is set excessively over a predetermined level, upward blowing against the lower portion of the cyclone can be prevented. Therefore, the performance for capturing the raw material can be maintained.

(4) Each of the rotary damper, the screw conveyer and the container prevents upward gas blowing and performs the continuous discharging of the raw material. Therefore, the foregoing effects can be exhibited and clogging in the blowing means can be prevented.

Seventh Aspect of the Present Invention

First to fourth embodiments of a seventh aspect of the present invention respectively are illustrated in FIGS. 27 to 30. A common overall system of the embodiments is shown in FIG. 32.

Figure 32:
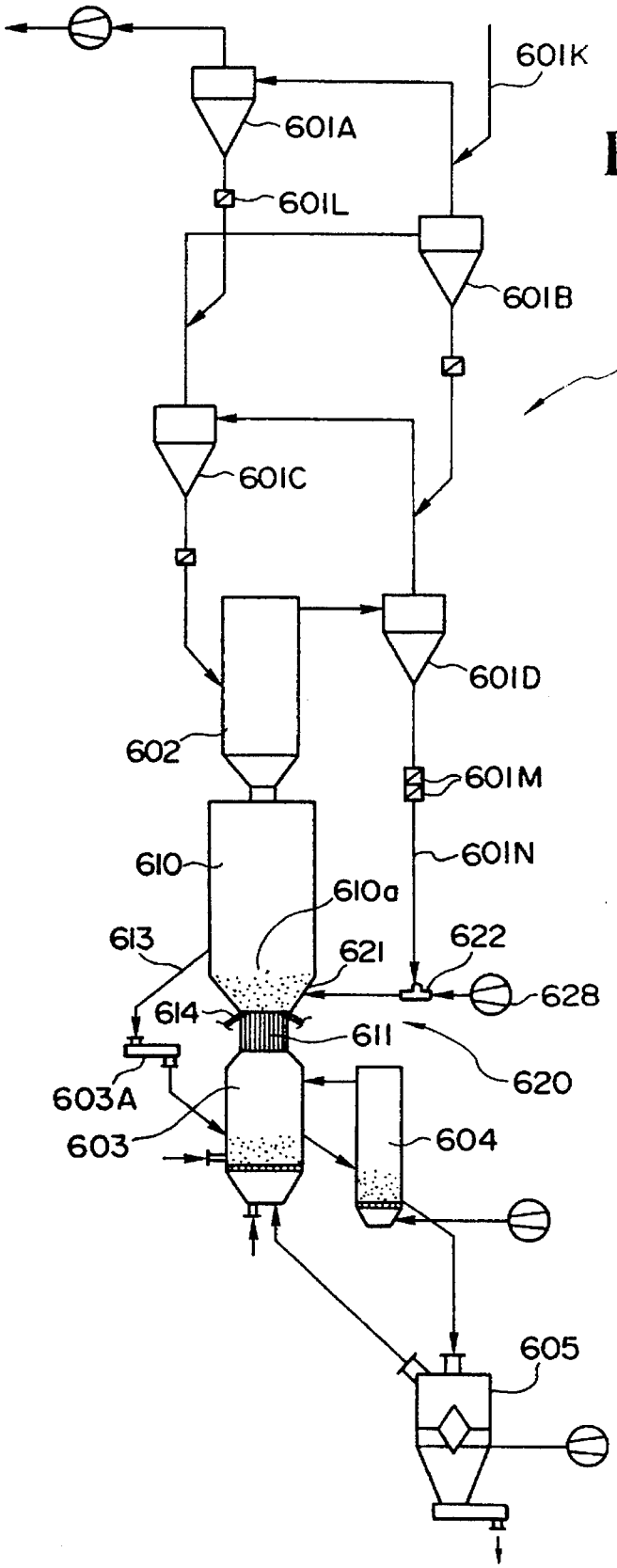
FIG. 32 is an overall system view which illustrates a cement clinker manufacturing equipment commonly used in the first to the fourth embodiment.
Figure 33:
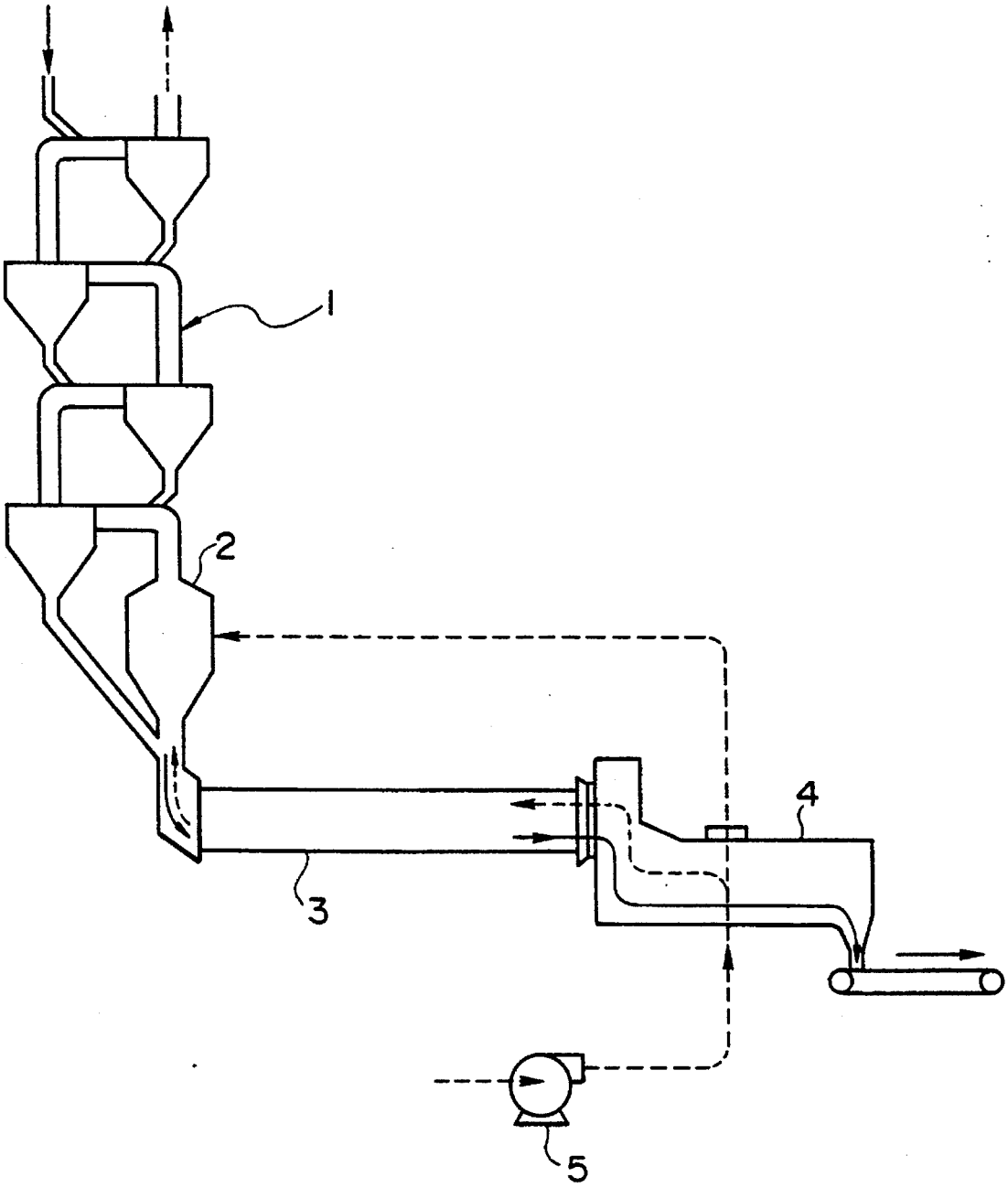
FIG. 33 is a structural view which illustrates a conventional cement clinker manufacturing apparatus.
Figure 34:
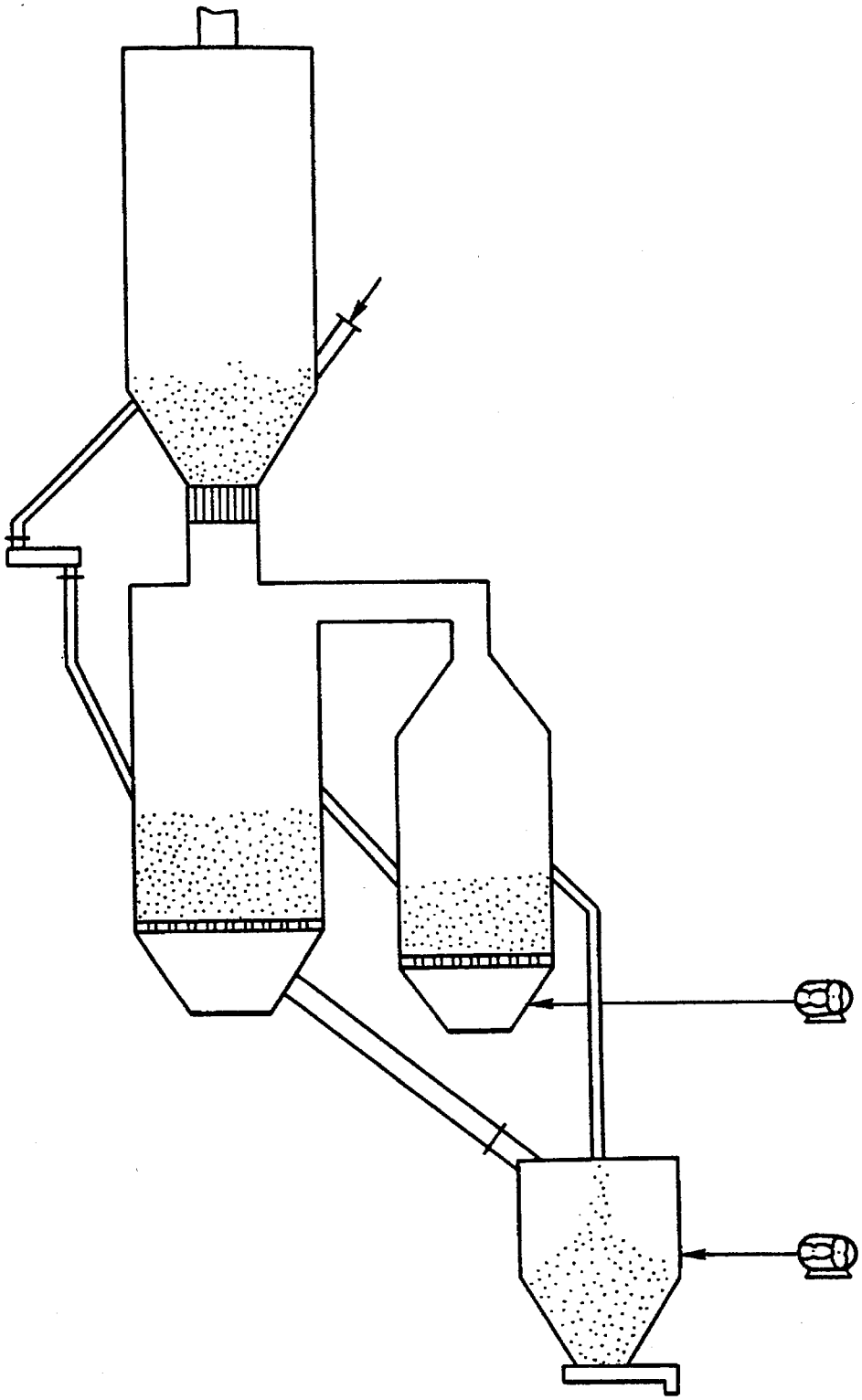
FIG. 34 is a schematic view which illustrates a conventional sintering apparatus.
Figure 35:
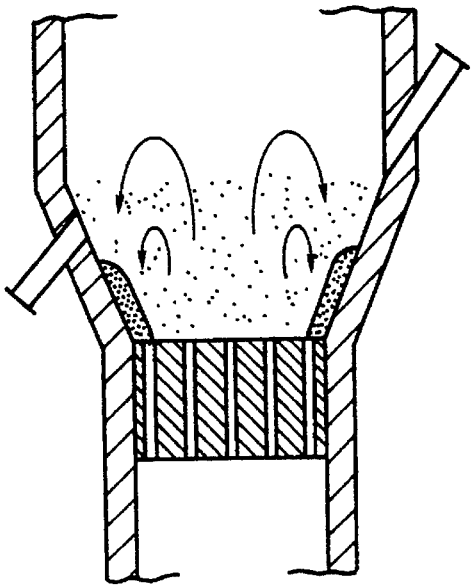
FIG. 35 is vertical front elevational view which illustrates a conventional granulating furnace.
Figure 36:
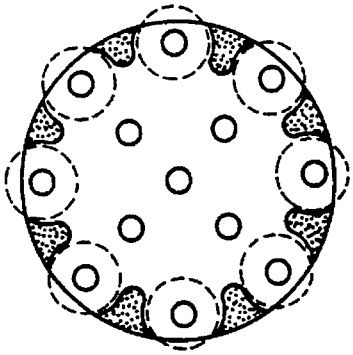
FIG. 36 is a plan view which illustrates a distributor of the conventional granulating furnace.
Figure 37:
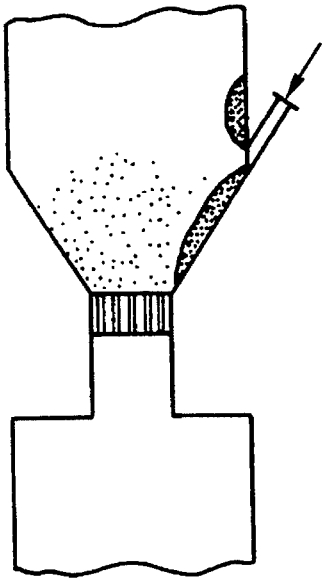
FIG. 37 is a schematic view which illustrates a conventional apparatus.
Figure 38:
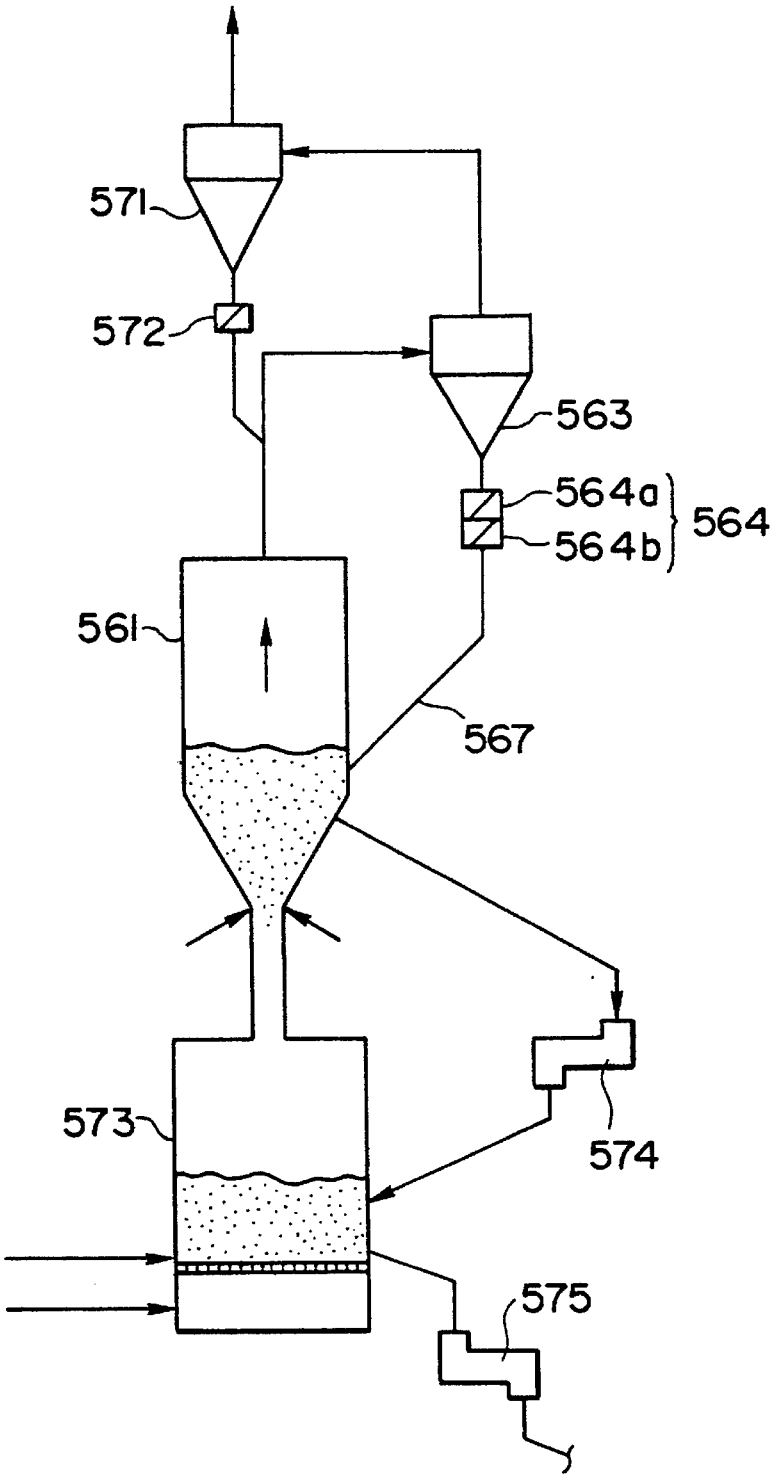
FIG. 38 is a schematic view which illustrates a conventional raw material injection apparatus together with a fluidized bed furnace.

FIG. 32 illustrates cement clinker manufacturing equipment, in which reference numeral 601 represents a suspension pre-heater including cyclones 601A to 601D and a valve 601L. Reference numeral 602 represents a pre-calciner, 610 represents a granulating furnace, 603 represents a sintering furnace, and 604 and 605 represent cooling units. Among the foregoing furnaces, the granulating furnace 610, the sintering furnace 603 and the cooling unit 604 are formed into the fluidized bed structure. The cooling unit 605 is formed into a packed bed structure. Raw material powder for cement charged into the system through an injection chute 601K is passed through the cyclones 601A to 601D and the pre-calciner 602 as to be pre-heated. Then, the raw material powder for cement is charged into the granulating furnace 610. The raw material powder is granulated to grains having a size of several millimeters, and then it is passed through a chute 613 and a hermetic discharge valve 603A as to be introduced into the sintering furnace 603. Granulated material sintered in the sintering furnace 603 is sent to the cooling unit 604 as to be subjected to primary cooling, and then it is subjected to secondary cooling in the cooling unit 605. Thus, the granulated material is recovered as cement clinker. Hot air supplied from the cooling units 604 and 605 is passed through the sintering furnace 603 as to be sent to the granulating furnace 610, the pre-calciner 602 and the suspension pre-heater 601. The granulating furnace 610 has, in the lower portion thereof, a porous perforated distributor 611 through which the hot air is passed. A fluidized bed 610*a* for raw material powder and the granulated material is formed on the distributor 611. Since the porous perforated distributor 611 is disposed in the apparatus dropping of the raw material powder and the granulated material can satisfactorily be prevented. Further, a heavy oil burner 614 is disposed adjacent to the top surface of the distributor 611.

Raw material powder captured by the cyclone 601D is passed through the double opening/closing damper 601M to prevent upward gas blowing, and it is passed through a supply chute 601N. Hitherto, the raw material powder has been then charged into the granulating furnace 610 due to the gravitation. In each embodiment to be described below, the raw material powder is blown into the furnace 610 by a blowing means or device 620 composed of a nozzle 621 formed on the side wall of the granulating furnace 610, an ejector 622 and a blower 628 connected to the nozzle 621. That is, the raw material powder is, together with compressed air supplied from the blower 628, blown into the furnace 610 through the nozzle 621 while being dropped onto the surface of a substantially horizontal portion in the ejector 622. The foregoing blowing method realizes the following advantages: the quantity of the raw material powder to be charged can easily be controlled as compared with the gravitation dropping method; the position to which it is charged can be set; and the grain size realized by granulating can be controlled by changing the state where the raw material powder is dispersed by the following structures.

Figure 27:
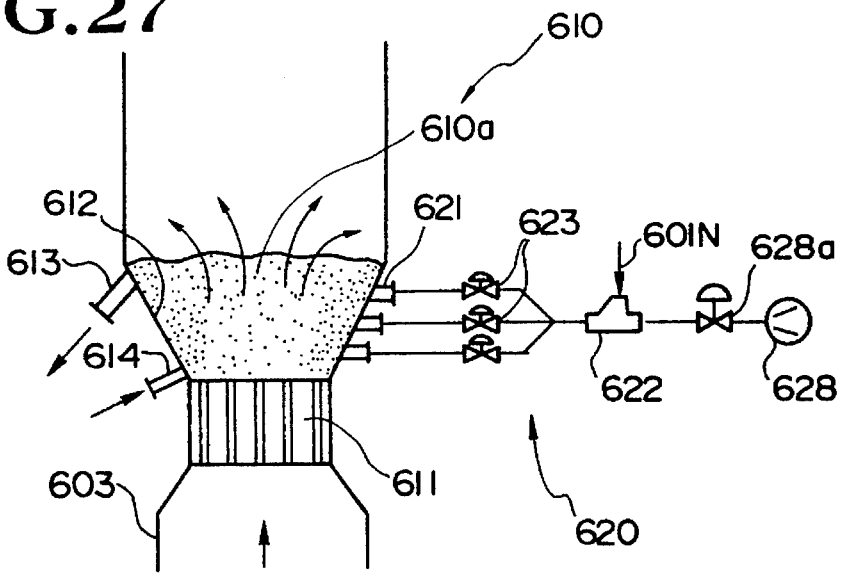
FIG. 27 is a cross sectional view which illustrates a jet fluidized bed furnace (a granulating furnace) including blowing means and according to a first embodiment of a seventh aspect of the present invention.

In the first embodiment shown in FIG. 27, the raw material powder blowing means 620 comprise three nozzles 621 disposed on the side wall of the furnace 610 while being vertically distributed. The nozzles 621 are respectively made to face horizontally and are arranged substantially perpendicularly to a cone portion 612, which is formed into an inverted frustum of circular cone, of the side wall of the furnace 610 in which the fluidized bed 610*a* is formed. Further, each nozzle 621 is provided with an opening/closing valve 623. In addition, the leading portion of the blower 628 (having a flow quantity adjustment valve 628*a*) and the ejector 622 are smoothly divided into three ways as illustrated as to be connected to the foregoing nozzles 621.

Figure 31A:
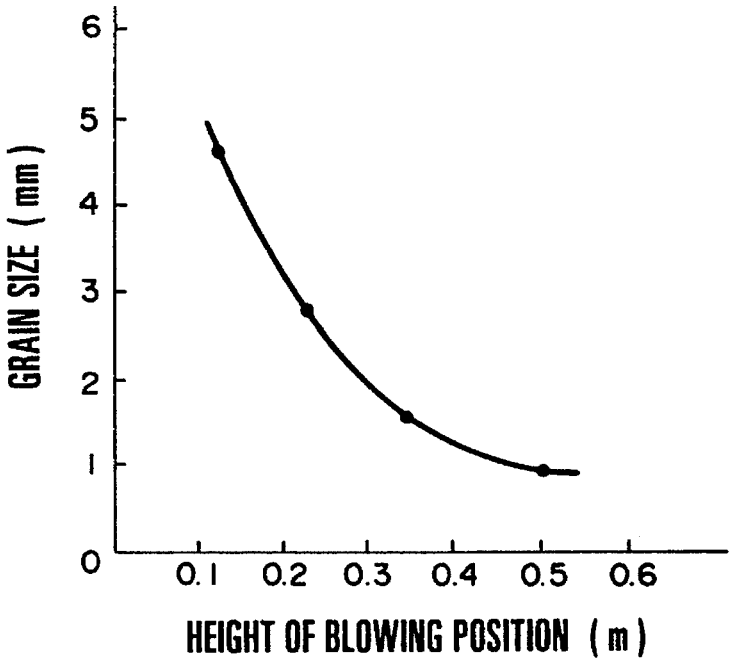
FIGS. 31A and 31B are graphs showing the results of experiments performed according to the present invention (the first embodiment)
Figure 31B:
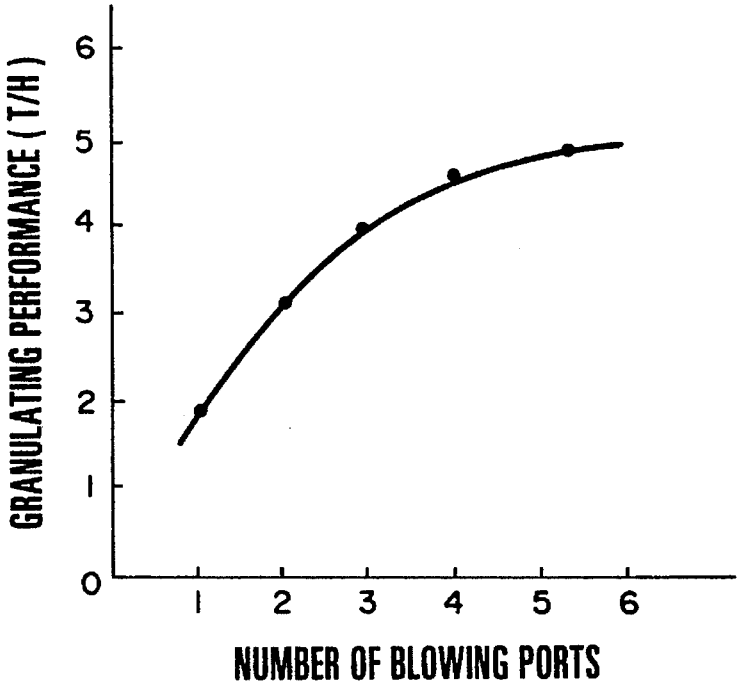

In this embodiment, selection of a nozzle from the nozzles 621, that is, determination of the opening/closing valves 623 to be opened or closed, enables the height at which the raw material powder is blown into the fluidized bed 610*a*. As a result, the grain size of the granulated material in the granulating furnace 610 can be changed. In accordance with the results of experiments, it was found that the foregoing granulating furnace 610 (which had a diameter of about 2 m, which included a fluidized bed 610*a* having a height (the bed height) of about 500 mm to 1000 mm (and the bed of which displayed temperature of about, 1300° C.) resulted in the relationship between the heights from the top surface of the distributor 611 to the nozzle 621 and the grain sizes realized by granulating as shown in FIG. 31A. If raw material powder is blown through the lower nozzle 621, the size of the granulated material is enlarged. Further, experiments resulted in that the relationship as shown in FIG. 31B to be found between the number of the blowing nozzles 621 (the number of blowing ports while making the quantities of the raw material powder to be blown by each nozzle 621 and compressed air to be constant) and the granulating performance per time. If the size of the granulated material is controlled by changing the (heights) of the nozzles 621, the response can be improved (the response time can be shortened to a small fraction of the time needed for the conventional arrangement in which the control is effected with the temperature of the fluidized bed 610*a*). Therefore, irregular grain size of the product cement clinker can be considerably prevented (the standard deviation of the grain size can be halved with respect to the conventional structure) even if a usual operation is performed.

The gas supplied from the sintering furnace 603 flows at a high speed at a low position adjacent to the top surface of the distributor 611 and it flows at relative low speed in the upper portion. Further, the gas is moved downwards together with the raw material powder adjacent to the inner wall of the cone portion 612. Since a plurality of burners 614 are disposed to face each other toward the central portion, a so-called local hot region is formed adjacent to the central portion of the distributor 611. The reason for this can be constituted that, since the flow velocity and the temperature are distributed in the fluidized bed 610*a* as described above, the change of the nozzles 621 to set the position in the fluidized bed 610*a* to which the raw material powder is blown will change the state of dispersion of the blown raw material powder, and therefore, the grain size can be changed.

Figure 28:
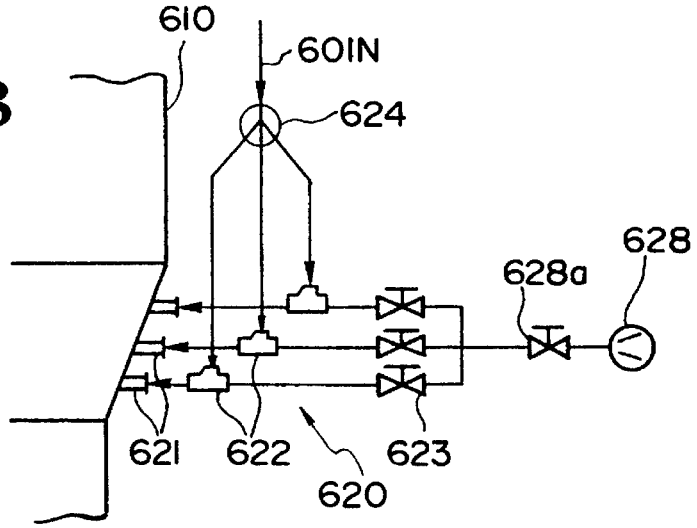
FIG. 28 is a side elevational view which illustrates a portion of a jet fluidized bed furnace according to a second embodiment of the seventh aspect of the present invention.

A second embodiment shown in FIG. 28 is arranged in such a manner that a plurality of nozzles 621 are vertically arranged on the side wall of the granulating furnace 610. This embodiment is characterized in that each nozzle 621 has an ejector 622. Each ejector 622 is supplied with raw material powder in such a manner that a branched chute is, while interposing a switching valve (or distributor) 624, connected to the supply chute 601N extending from an upper position. Although the blowing means 620 has a somewhat complicated structure as compared with the embodiment shown in FIG. 27, an advantage can be obtained in that the quantities of the raw material powder and air to be blown by the respective nozzles 621 can be accurate controlled.

Figure 29:
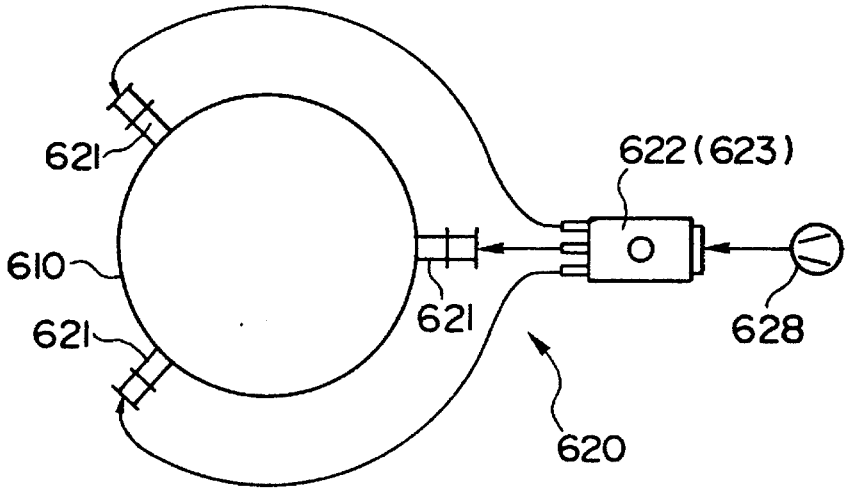
FIG. 29 is a plan view which illustrates a jet fluidized bed furnace according to a third embodiment of the seventh aspect of the present invention.

A third embodiment shown in FIG. 29 is arranged in such a manner that a plurality of nozzles 621 are disposed on the side wall of the granulating furnace 610 in the circumferential direction of the same at predetermined intervals. An ejector 622 acting as the opening/closing valve 623 for each nozzle 621 is connected to a passage from the blower 628 to each nozzle 621. By arbitrarily setting the number of the blowing nozzles 621, the state of granulation can be controlled. If the total quantity (the total quantity of raw material powder to be blown from each nozzle 621 per unit time) is made constant and if the quantity to be blown from each nozzle 621 and the number of the blowing ports are changed, the grain size realized by granulating can be changed. If only the number of ports is changed to change the total quantity, the quantity of granulation can be changed as shown in FIG. 31B.

Figure 30:
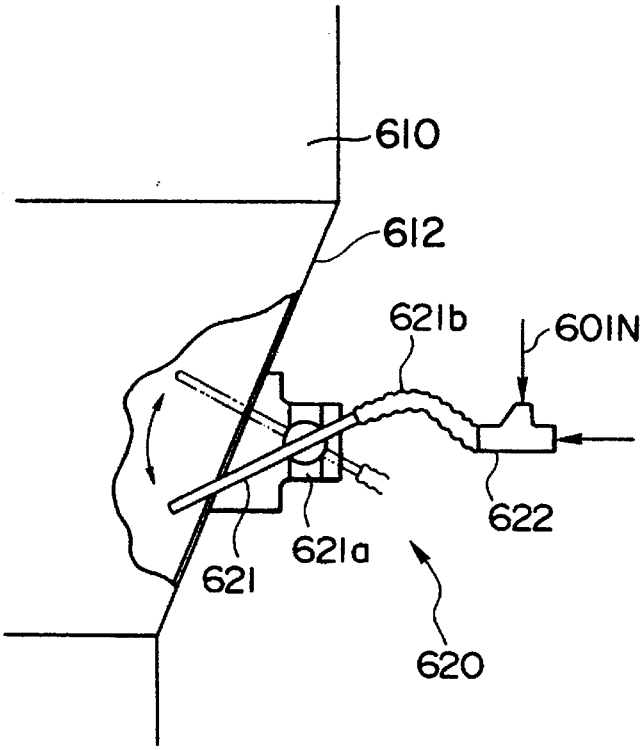
FIG. 30 is a side elevational view which illustrates a portion of a jet fluidized bed furnace according to a fourth embodiment of the seventh aspect of the present invention.

In the fourth embodiment shown in FIG. 30, the direction of the nozzle 621 can be varied in the four directions (both vertically and laterally). That is, the nozzle 621 is fastened to the side wall of the granulating furnace 610 by using a spherical supporting member 621*a* while being connected to the ejector 622 by a flexible pipe 621*b*. By changing the blowing angle made by the nozzle 621, the blowing height of raw material powder and the radial blowing position into the fluidized bed 610*a* can be changed. As a result, the grain size can be controlled quickly and assuredly.

Further, a structure, in which a flow quantity adjustment valve 628*a* (see FIG. 27 and so forth) provided for the blower 628 is operated to change only the quantity of blown air or the like, will control the grain size realized in the granulating furnace 610. The reason for this can be considered that the state of the raw material powder dispersion can arbitrarily be changed.

Although the description has been made mainly about the control of the grain size in the granulation process for manufacturing cement clinker, the control method and the fluidized bed furnace according to the present invention can effectively be embodied in other granulation processes so far as a process is included in which raw material powder is partially melted and allowed to adhere to one another while being fluidized. The foregoing adaptation is exemplified by a pre-heating granulation of the material of glass.

Effect of the Seventh Aspect

According to the seventh aspect of the present invention, the grain size realized by the granulation process performed in the fluidized bed furnace can assuredly be controlled while maintaining excellent response. As a result, satisfactory granulated material which exhibits reduced scattering of the grain sizes can be obtained. The fluidized bed granulating furnace according to the present invention is able to embody the foregoing control method by necessitating a simple structure.

Although the invention has been described in its preferred form with a certain degree of particularly, it is understood that the present disclosure of the preferred form can be changed in the details of construction and the combination and arrangement of parts may be resorted to without departing from the spirit and the scope of the invention as hereinafter claimed.

What is claimed is:

1. An apparatus for manufacturing cement clinker comprising a unit for pre-heating raw material of the cement clinker, a pre-calcining unit in material communication with the pre-heating unit, a sintering unit comprising a fluidized bed furnace which is in material communication with a cooling unit for cooling and recovering said sintered cement clinker, at least one quick heating furnace comprising a jet fluidized bed furnace for granulating said raw material for cement clinker in which granulated material is charged into said fluidized bed furnace by way of a discharge chute, said jet fluidized bed furnace arranged intermediate and in material communication with said pre-calcining unit and said fluidized bed furnace, each of which said at least one quick heating furnace is capable of heating said raw material of cement clinker from a pre-heating temperature to a sintering reaction temperature in the range of 1300° C. to 1400° C. at a heating rate of at least 100° C./minute and maintaining said temperature range, a fuel supply means for forming a local hot region positioned immediately above a distributor disposed in a throat portion between said jet fluidized bed furnace and said fluidized bed furnace and formed into a porous perforated plate structure, an inverse frustum of circular cone (a cone portion) capable of causing said granulated material to be formed into a downward moving bed formed adjacent to a side wall of a lower portion of said jet fluidized bed furnace immediately above said distributor, and means for blowing and supplying said pre-heated raw material of cement clinker connected to a side wall of said inverse frustum of circular cone so that said raw material of cement clinker is sufficiently dispersed in said downward moving bed and said raw material of cement clinker reaches said local hot region, wherein said pre-heating unit comprises a suspension pre-heater including a plurality of cyclones with a lowermost cyclone and a raw material injection chute arranged between the lowermost cyclone and an ejector of a pressurized-air supplying pipe disposed between said jet fluidized bed furnace and a source of pressurized air, said ejector adapted to supply said raw material for blowing to a lower portion of a fluidized bed in said cone portion of said jet fluidized bed furnace, and a double opening/closing damper connected to the lower portion of said lowermost cyclone and discharge means and disposed between said damper and said raw material blowing ejector into said jet fluidized bed furnace, said discharge means being arranged to retain said raw material to interrupt air communication between the upstream and the downstream and to continuously discharge said raw material into a blowing means.

2. An apparatus for manufacturing cement clinker according to claim 1, wherein the upper portion of said discharge means and a gas passage at the inlet port of said cyclone are connected to each other by a pipe including a gas quantity adjustment means.

3. An apparatus for manufacturing cement clinker according to claim 1, wherein said discharge means is a rotary damper having a function for crushing coarse grains.

4. An apparatus for manufacturing cement clinker according to claim 1, wherein said discharge means is a screw conveyer including a portion for filling with said raw material, within said screw conveyer being disposed a screw in a passage through which said raw material is conveyed.

5. An apparatus for manufacturing cement clinker according to claim 1, wherein said discharge means is a container including a gas introduction pipe connected to the bottom portion of a raw material fluidizing portion to form a fluidized bed together with a distributor a raw material supply chute arranged from an upper portion to said fluidized bed and a raw material/gas discharge chute for supplying the same from said fluidized bed to said blowing means in an overflow manner.

6. An apparatus for manufacturing cement clinker according to claim 5, wherein said gas for forming said fluidized bed is hot process gas.

7. An apparatus for manufacturing cement clinker according to claim 1 wherein the top surface of said porous perforated distributor is made lower than the top end of said throat and a flow rectifying region is formed.

8. An apparatus for manufacturing cement clinker according to claim 1 wherein a circular cone blind member is disposed adjacent to the central portion of the top surface of said porous perforated distributor of said granulating furnace to form an annular fluidized bed.

9. An apparatus for manufacturing cement clinker according to claim 1 wherein said pressurized gas for blowing said raw material is hot process gas.

10. An apparatus for manufacturing cement clinker according to claim 1 wherein a large-diameter nozzle is disposed at the central portion of said porous perforated distributor of said jet fluidized bed furnace and small-diameter nozzles are disposed in the periphery of the same.

11. An apparatus for manufacturing cement clinker according to claim 10 wherein the diameter of the outermost nozzle formed on said porous perforated distributor of said granulating furnace is made in such a manner that the diameter of a jet stream discharged from said outermost nozzle is larger than the nozzle pitch.

12. An apparatus for manufacturing cement clinker according to claim 10 wherein a fuel blowing nozzle is disposed adjacent to said large-diameter nozzle which itself is disposed at the central portion of said porous perforated distributor of said jet fluidized bed furnace.

13. An apparatus for manufacturing cement clinker according to claim 1 further including means for cooling cement clinker including a primary cooler and a secondary cooler and each of said primary and secondary coolers is supplied with a cooling medium from an independent forcible blower.

14. An apparatus for manufacturing cement clinker according to claim 13 further comprising means for measuring the grain size of granulated material discharged from said jet fluidized bed furnace, and means for controlling the quantity of air forcibly blown by said primary and secondary coolers in accordance with a measurement result signal denoting that said measured grain size is deviated from a predetermined grain size range.

15. An apparatus for manufacturing cement clinker according to claim 13 wherein said secondary cooler is a packing bed cooler or a multi-chamber fluidized bed cooler.

16. An apparatus for manufacturing cement clinker according to claim 13 wherein said primary cooler is a fluidized bed cooler.

17. An apparatus for manufacturing cement clinker according to claim 1, further comprising means for changing conditions under which said raw material powder is blown into said granulating furnace, wherein the grain size is controlled by said changing means.

18. An apparatus for manufacturing cement clinker according to claim 17 wherein a plurality of blowing means are, as means for changing said blowing conditions, disposed in a circumferential direction of said side wall of said cone portion of said granulating furnace at intervals, said blowing means including means which can be changed over to perform blowing and stopping blowing.

19. An apparatus for manufacturing cement clinker according to claim 17 wherein a blowing means capable of changing the blowing angle is, as means for changing said blowing conditions, disposed on said side wall of said cone portion of said jet fluidized bed furnace.

20. An apparatus for manufacturing cement clinker according to claim 17 wherein a plurality of blowing means are, as means for changing said blowing conditions, disposed in a direction of the height of said side wall of said cone portion of said granulating furnace at intervals, said blowing means including means which can be changed over to perform blowing and stopping blowing.

21. An apparatus of manufacturing cement clinker according to claim 20 wherein a gas flow quantity adjustment means is provided so that the velocity of flow from said blowing means into said jet fluidized bed furnace is enabled to be changed.

* * * * *